US010626578B2

(12) United States Patent
Izumi et al.

(10) Patent No.: US 10,626,578 B2
(45) Date of Patent: Apr. 21, 2020

(54) WORK MACHINE

(71) Applicant: HITACHI CONSTRUCTION MACHINERY CO., LTD., Tokyo (JP)

(72) Inventors: Shiho Izumi, Hitachinaka (JP); Ryuu Narikawa, Mito (JP); Shuuichi Meguriya, Ishioka (JP); Tarou Akita, Kasumigaura (JP); Kouji Ishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 62 days.

(21) Appl. No.: 16/081,041

(22) PCT Filed: Feb. 28, 2017

(86) PCT No.: PCT/JP2017/007996
§ 371 (c)(1),
(2) Date: Aug. 30, 2018

(87) PCT Pub. No.: WO2018/008190
PCT Pub. Date: Jan. 11, 2018

(65) Prior Publication Data

US 2019/0106861 A1 Apr. 11, 2019

(30) Foreign Application Priority Data

Jul. 6, 2016 (JP) ..... 2016-134408

(51) Int. Cl.
*E02F 9/22* (2006.01)
*F15B 11/08* (2006.01)
(Continued)

(52) U.S. Cl.
CPC ..... *E02F 9/2203* (2013.01); *E02F 3/32* (2013.01); *E02F 3/425* (2013.01); *E02F 3/43* (2013.01);
(Continued)

(58) Field of Classification Search
CPC ..... F15B 11/024; F15B 11/16; F15B 21/14; E02F 3/437; E02F 9/2203; E02F 9/2217
See application file for complete search history.

(56) References Cited

U.S. PATENT DOCUMENTS 5,442,912 A * 8/1995 Hirata ..... E02F 9/2217 60/426
5,835,874 A 11/1998 Hirata et al.
(Continued)

FOREIGN PATENT DOCUMENTS

JP 06-081375 A 3/1994
JP 08-128065 A 5/1996
(Continued)

OTHER PUBLICATIONS

International Preliminary Report on Patentability received in corresponding International Application No. PCT/JP2017/007996 dated Jan. 17, 2019.
International Search Report of PCT/JP2017/007996 dated Jun. 6, 2017.

*Primary Examiner* — Michael Leslie
(74) *Attorney, Agent, or Firm* — Mattingly & Malur, PC

(57) ABSTRACT

A work machine has a controller which has an area limiting control section correcting the pilot pressures of pilot lines, a regeneration control section adjusting the flow rate of the hydraulic fluid caused to flow from a tank side line of an arm cylinder into a pump side line thereof between zero and a predetermined upper limit value, and a regeneration control switching section that issues an order to the regeneration control section to set the predetermined upper limit value to a first set value when the function of the area limiting control section is invalid and that issues an order to the regeneration control section to set the predetermined upper limit value to a second set value that is smaller than the first set value when the function of the area limiting control section is effective.

6 Claims, 17 Drawing Sheets

(51) Int. Cl.

| | |
|---|---|
| ***E02F 3/43*** | (2006.01) |
| ***F15B 11/05*** | (2006.01) |
| ***F15B 11/024*** | (2006.01) |
| ***E02F 3/32*** | (2006.01) |
| ***E02F 3/42*** | (2006.01) |
| ***F15B 11/16*** | (2006.01) |
| ***F15B 21/14*** | (2006.01) |

(52) U.S. Cl.

CPC ..... *E02F 3/435* (2013.01); *E02F 9/2225* (2013.01); *F15B 11/024* (2013.01); *F15B 11/05* (2013.01); *F15B 11/08* (2013.01); *F15B 11/16* (2013.01); *F15B 21/14* (2013.01); *F15B 2211/205* (2013.01); *F15B 2211/428* (2013.01); *F15B 2211/526* (2013.01); *F15B 2211/575* (2013.01); *F15B 2211/6355* (2013.01); *F15B 2211/6654* (2013.01); *F15B 2211/67* (2013.01); *F15B 2211/7054* (2013.01); *F15B 2211/71* (2013.01)

(56) References Cited

U.S. PATENT DOCUMENTS

| | | | | | |
|---|---|---|---|---|---|
| 5,918,527 | A | * | 7/1999 | Haga | E02F 3/437 91/363 R |
| 5,960,378 | A | * | 9/1999 | Watanabe | E02F 3/437 37/415 |
| 6,076,029 | A | * | 6/2000 | Watanabe | E02F 3/437 701/50 |
| 9,725,874 | B2 | * | 8/2017 | Meguriya | E02F 3/437 |
| 10,280,948 | B2 | * | 5/2019 | Vigholm | F15B 11/16 |
| 2017/0101761 | A1 | | 4/2017 | Wu | |

FOREIGN PATENT DOCUMENTS

| | | | |
|---|---|---|---|
| JP | 11-021941 | A | 1/1999 |
| JP | 11-101202 | A | 4/1999 |
| JP | 3056254 | B2 | 6/2000 |
| JP | 3594680 | B2 | 12/2004 |
| WO | 2015/194601 | A1 | 12/2015 |

* cited by examiner

WORK MACHINE

TECHNICAL FIELD

The present invention relates to a work machine endowed with a function by which the driving of a hydraulic actuator is controlled automatically or semi-automatically.

BACKGROUND ART

In a hydraulic excavator, a boom, an arm, and a bucket constituting a front work device are rotatably supported, and when the boom, the arm, or the bucket is moved singly, the bucket forward end draws an arcuate locus. Thus, in forming a linear finish surface with the bucket forward end through, for example, an arm drawing operation, it is necessary for the operator to perform a combined operation on the boom, the arm, and the bucket, and great skill is required of the operator.

In this regard, a technique is available according to which a function (machine control) by which the driving of the hydraulic actuators is controlled automatically or semi-automatically by a computer (controller) is applied to excavation work, with the bucket forward end being moved along the design surface (target excavation surface) at the time of excavation operation (at the time of operation of the arm or the bucket) (Patent Document 1).

On the other hand, some conventional hydraulic excavators are equipped with a hydraulic regeneration device which causes the hydraulic fluid in the tank side line of a hydraulic actuator to flow into the pump side line (hydraulic fluid regeneration), thereby increasing the operational speed of the hydraulic actuator (Patent Document 2).

PRIOR ART DOCUMENT

Patent Document

Patent Document 1: Japanese Patent No. 3056254
Patent Document 2: Japanese Patent No. 3594680

SUMMARY OF THE INVENTION

Problem to be Solved by the Invention

In the case where machine control is applied to a hydraulic excavator equipped with a hydraulic regeneration device capable of increasing the expansion/contraction speed of the arm cylinder, hydraulic fluid regeneration is effected in the arm cylinder during the movement of the bucket forward end along the target excavation surface by the machine control, and the arm operational speed fluctuates, whereby there is a fear of the bucket forward end being further engaged in the ground than the target excavation surface.

The present invention has been made in view of the above problem. It is an object of the present invention to provide a work machine in which fluctuation in the speed of the hydraulic actuator due to hydraulic fluid regeneration during the execution of machine control is suppressed, thereby making it possible to improve work efficiency while securing the control accuracy of the machine control.

Means for Solving the Problem

To achieve the above object, there is provided, in accordance with the present invention, a work machine including: a machine body; a front work device provided on the machine body; a plurality of hydraulic actuators driving the front work device; a hydraulic pump; a plurality of flow control valves controlling a hydraulic fluid flow supplied from the hydraulic pump to the plurality of hydraulic actuators; a plurality of operation devices designating operation of the plurality of hydraulic actuators; a plurality of pilot lines connecting the plurality of operation devices and pilot sections of the plurality of flow control valves; a solenoid proportional valve provided in at least one predetermined pilot line of the plurality of pilot lines; and a controller controlling the solenoid proportional valve to correct pilot pressure of the predetermined pilot line, thereby controlling driving of the front work device, the work machine further including: a regeneration circuit causing the hydraulic fluid in a tank side line of the predetermined hydraulic actuator of the plurality of hydraulic actuators to flow into a pump side line thereof. The controller has an area limiting control section controlling the solenoid proportional valve such that the front work device does not intrude under a target excavation surface, a regeneration control section adjusting flow rate of the hydraulic fluid caused to flow into the pump side line via the regeneration circuit, between zero and a predetermined upper limit value, and a regeneration control switching section that issues an order to the regeneration control section to set the predetermined upper limit value to a first set value when function of the area limiting control section is invalid, and that issues an order to the regeneration control section to set the predetermined upper limit value to a second set value that is smaller than the first set value when the function of area limiting control section is effective.

Effect of the Invention

According to the present invention, fluctuation in the speed of the hydraulic actuator accompanying hydraulic fluid regeneration is suppressed during machine control, whereby it is possible to improve work efficiency while securing the control accuracy of the machine control.

MODES FOR CARRYING OUT THE INVENTION

Figure 1:
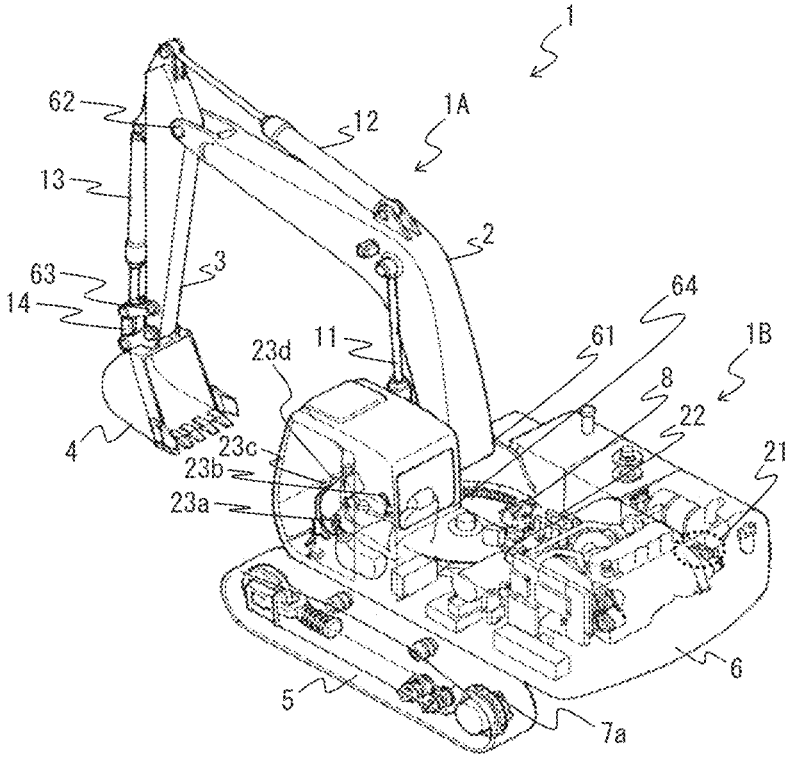
FIG. 1 is an external view of a hydraulic excavator as an example of a work machine according to a first embodiment of the present invention.

In the following, embodiments of the present invention will be described with reference to the drawings. In the drawings, the same components are indicated by the same reference numerals, and a redundant description will be left out as appropriate. While in the following, a hydraulic excavator equipped with a bucket as the attachment at the distal end of the front work device is taken as an example, the present invention may be applied to a hydraulic excavator equipped with an attachment other than a bucket. Further, while in the following description, in the case where there exist a plurality of similar components, an alphabetical letter may be added to the end of a numeral (number), in some cases, such alphabetic letter is omitted, and the plurality of components are collectively expressed. For example, when there exist four operation levers 23*a*, 23*b*, 23*c*, and 23*d*, these may be collectively expressed as the operation levers 23.

Embodiment 1

Figure 2:
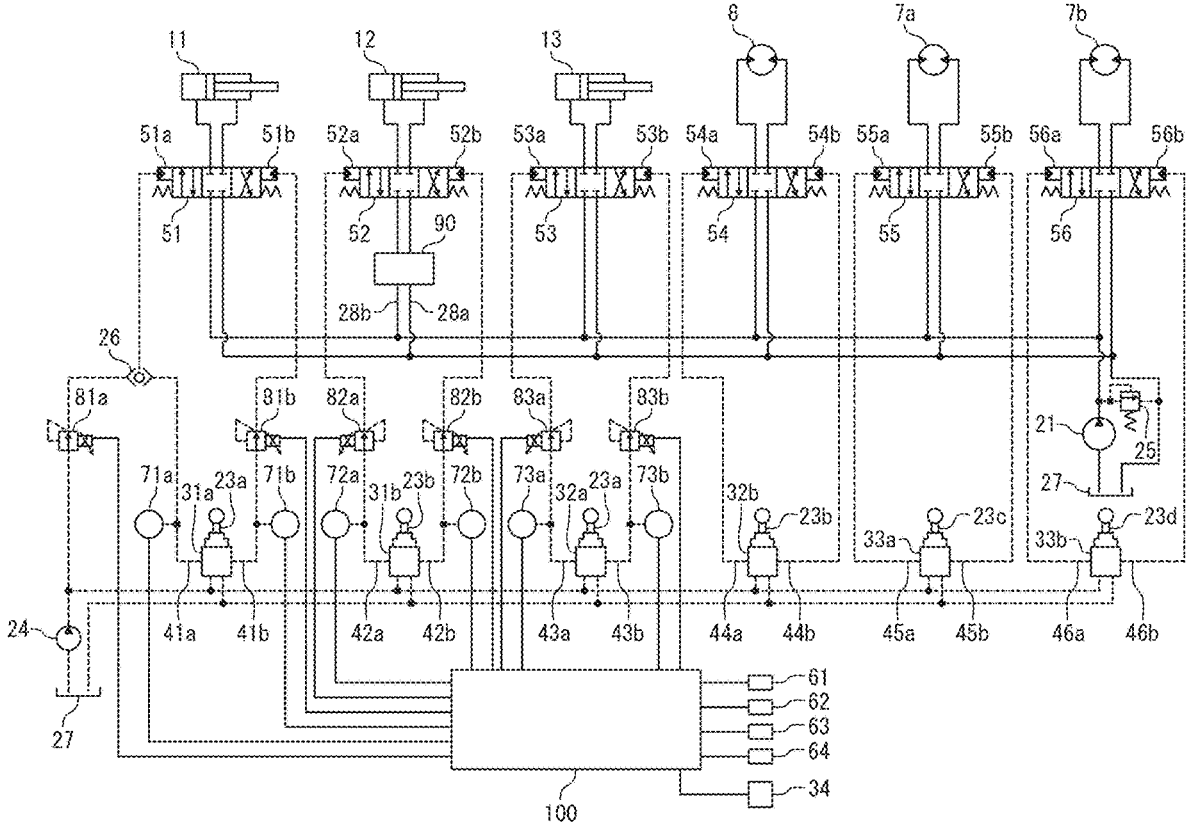
FIG. 2 is a diagram illustrating a hydraulic drive system with which the hydraulic excavator shown in FIG. 1 is equipped along with a controller.

FIG. 1 is an external view of a hydraulic excavator as an example of a work machine according to a first embodiment of the present invention, and FIG. 2 is a diagram illustrating a hydraulic drive system with which the hydraulic excavator shown in FIG. 1 is equipped along with a controller.

In FIG. 1, a hydraulic excavator 1 is composed of a front work device 1A and a machine body 1B. The machine body 1B is composed of a lower track structure 5, and an upper swing structure 6 swingably mounted on top of the lower track structure 5. The front work device 1A is formed by connecting a plurality of driven members (a boom 2, an arm 3, and a bucket 4) each rotating in the vertical direction, and the proximal end of the boom 2 of the front work device 1A is supported by the front portion of the upper swing structure 6.

The boom 2, the arm 3, the bucket 4, the upper swing structure 6, and the lower track structure 5 constitute driven members driven by a boom cylinder 11, an arm cylinder 12, a bucket cylinder 13, a swing hydraulic motor 8, and left and right traveling hydraulic motors 7*a* and 7*b*. Operational designation to these driven members 2 through 6 is outputted in accordance with the operation by the operator of a left traveling lever 23*c*, a right traveling lever 23*d*, a left operation lever 23*a*, and a right operation lever 23*b* mounted in a cab on the upper swing structure 6 (These are sometimes generally referred to as the operation levers).

Installed in the cab are an operation device 33*a* (shown in FIG. 2) having the left traveling lever 23*c*, an operation device 33*b* (shown in FIG. 2) having the right traveling lever 23*d*, operation devices 31*a* and 32*a* sharing the left operation lever 23*a*, and operation devices 31*b* and 32*b* sharing the right operation lever 23*b*. The operation devices 31 through 33 are of the hydraulic pilot type. They supply pilot pressures in accordance with the operation amounts (e.g., the lever stroke) and the operation directions of the operation levers 23 operated by the operator to corresponding pilot sections 51*a*, 51*b*, . . . 56*a*, and 56*b* of flow control valves 51 through 56 (shown in FIG. 2) via pilot lines 41 through 46 (shown in FIG. 2) as control signals, thereby driving the flow control valves 51 through 56.

The hydraulic fluid delivered from the hydraulic pump 21 is supplied to the left traveling hydraulic motor 7*a*, the right traveling hydraulic motor 7*b*, the swing hydraulic motor 8, the boom cylinder 11, the arm cylinder 12, and the bucket cylinder 13 via the flow control valves 51 through 56 (shown in FIG. 2) in a control valve unit 22. Due to the hydraulic fluid supplied, the boom cylinder 11, the arm cylinder 12, and the bucket cylinder 13 expand and contract, whereby the boom 2, the arm 3, and the bucket 4 rotate, and the position and posture of the bucket 4 are varied. Further, due to the hydraulic fluid supplied, the swing hydraulic motor 8 is rotated, whereby the upper swing structure 6 rotates with respect to the lower track structure 5. Further, due to the hydraulic fluid supplied, the left and right traveling hydraulic motors 7*a* and 7*b* rotate, whereby the lower track structure 5 travels.

In order that the rotational angles $\alpha$, $\beta$, and $\gamma$ (shown in FIG. 5) can be measured, a boom angle sensor 61, an arm angle sensor 62, and a bucket angle sensor 63 are mounted on the boom pin of the boom 2, the arm pin of the arm 3, and the bucket link 14, respectively. Mounted on the upper swing structure 6 is a machine body inclination angle sensor 64 detecting the inclination angle $\theta$ (shown in FIG. 5) in the front-rear direction of the upper swing structure 6 (machine body 1B) with respect to the reference surface (e.g., the horizontal surface).

As shown in FIG. 2, the hydraulic excavator 1 of FIG. 1 has the hydraulic pump 21, a plurality of hydraulic actuators including the boom cylinder 11, the arm cylinder 12, the bucket cylinder 13, the swing hydraulic motor 8, and the left and right traveling hydraulic motors 7*a* and 7*b* which are driven by the hydraulic fluid from the hydraulic pump 21, the left traveling lever 23*c*, the right traveling lever 23*d*, the left operation lever 23*a*, and the right operation lever 23*b* provided in correspondence with the hydraulic actuators 7, 8, and 11 through 13, a plurality of flow control valves 51 through 56 connected between the hydraulic pump 21 and the plurality of hydraulic actuators 7, 8, and 11 through 13, controlled by control signals outputted from the operation devices 31 through 33 in accordance with the operation amount and the operational direction of the operation lever 23, and controlling the flow rate and direction of the hydraulic fluid supplied to the hydraulic actuators 7, 8, and 11 through 13, a relief valve 25 configured to be opened when the pressure between the hydraulic pump 21 and the flow control valves 51 through 56 has become equal to or more than a set value to cause the hydraulic fluid to escape to a tank 27, and a regeneration circuit 90 causing the hydraulic fluid in a tank side line 28*a* of the arm cylinder 12 to flow into a pump side line 28*b* thereof. These constitute a hydraulic drive system driving the driven members 2 through 6 of the hydraulic excavator 1.

The hydraulic excavator 1 of the present embodiment is equipped with a control system (hereinafter referred to as the "excavation control system") aiding the excavation operation of the operator. The excavation control system performs, for example, a control (hereinafter referred to as "area limiting control") to forcibly raise the boom 2 such that the bucket forward end (the claw tip of the bucket 4) is not engaged deeper in the ground than a target excavation surface 200 (shown in FIG. 4).

The excavation control system of the present embodiment is equipped with: an area limiting switch 34 installed at a position where it does not interfere with the field of vision of the operator, such as above an operational panel in the cab and switching between effective/invalid of the area limiting control; pressure sensors 71*a* and 71*b* provided in pilot lines 41*a* and 41*b* of the operation device 31*a* for the boom 2 and detecting a pilot pressure (control signal) as the operation amount of the boom raising direction or the boom lowering direction of the operation lever 23*a*; pressure sensors 72*a* and 72*b* provided in pilot lines 42*a* and 42*b* of the operation device 31*b* for the arm 3 and detecting a pilot pressure (control signal) as the operation amount in the arm drawing direction or the arm pushing direction of the operation lever 23*b*; pressure sensors 73*a* and 73*b* provided in pilot lines 43*a* and 43*b* of the operation device 32*a* for the bucket 4 and detecting a pilot pressure (control signal) as the operation amount in the bucket crowding direction or the bucket dumping direction of the operation lever 23*a*; a solenoid proportional valve 81*a* a primary port side of which is connected to a pilot pump 24 and which reduces and outputs a pilot pressure from the pilot pump 24; a shuttle valve 26 connected to a pilot line 41*a* of the operation device 31*a* for the boom 2 and a secondary port side of the solenoid proportional valve 81*a*, selecting the higher of the pilot pressure in the pilot line 41*a* and a control pressure outputted from the solenoid proportional valve 81*a*, and guiding it to a pilot section 51*a* of the flow control valve 51; a solenoid proportional valve 81*b* installed in a pilot line 41*b* of the operation device 31*a* for the boom 2 and reducing and outputting the pilot pressure in the pilot line 41*b* in accordance with an electric signal; solenoid proportional valves 82*a* and 82*b* installed in pilot lines 42*a* and 42*b* of the operation device 31*b* for the arm 3 and reducing and outputting the pilot pressure in the pilot lines 42*a* and 42*b* in accordance with an electric signal; solenoid proportional valves 83*a* and 83*b* installed in pilot lines 43*a* and 43*b* of the operation device 32*b* for the bucket 4 and reducing and outputting the pilot pressure in the pilot lines 43*a* and 43*b* in accordance with an electric signal; and a controller 100 consisting of a computer or the like capable of executing various computations.

The controller 100 performs various computations based on a switching signal from the area limiting switch 34, configuration information and positional information on the target excavation surface 200 set by a target excavation surface setting device 35 described below, detection signals from the angle sensors 61 through 63 and the inclination angle sensor 64, and detection signals from the pressure sensors 71 through 73, and outputs an operation signal for correcting the pilot pressures of the pilot lines 41 through 43 to the solenoid proportional valves 81 through 83.

Figure 3:
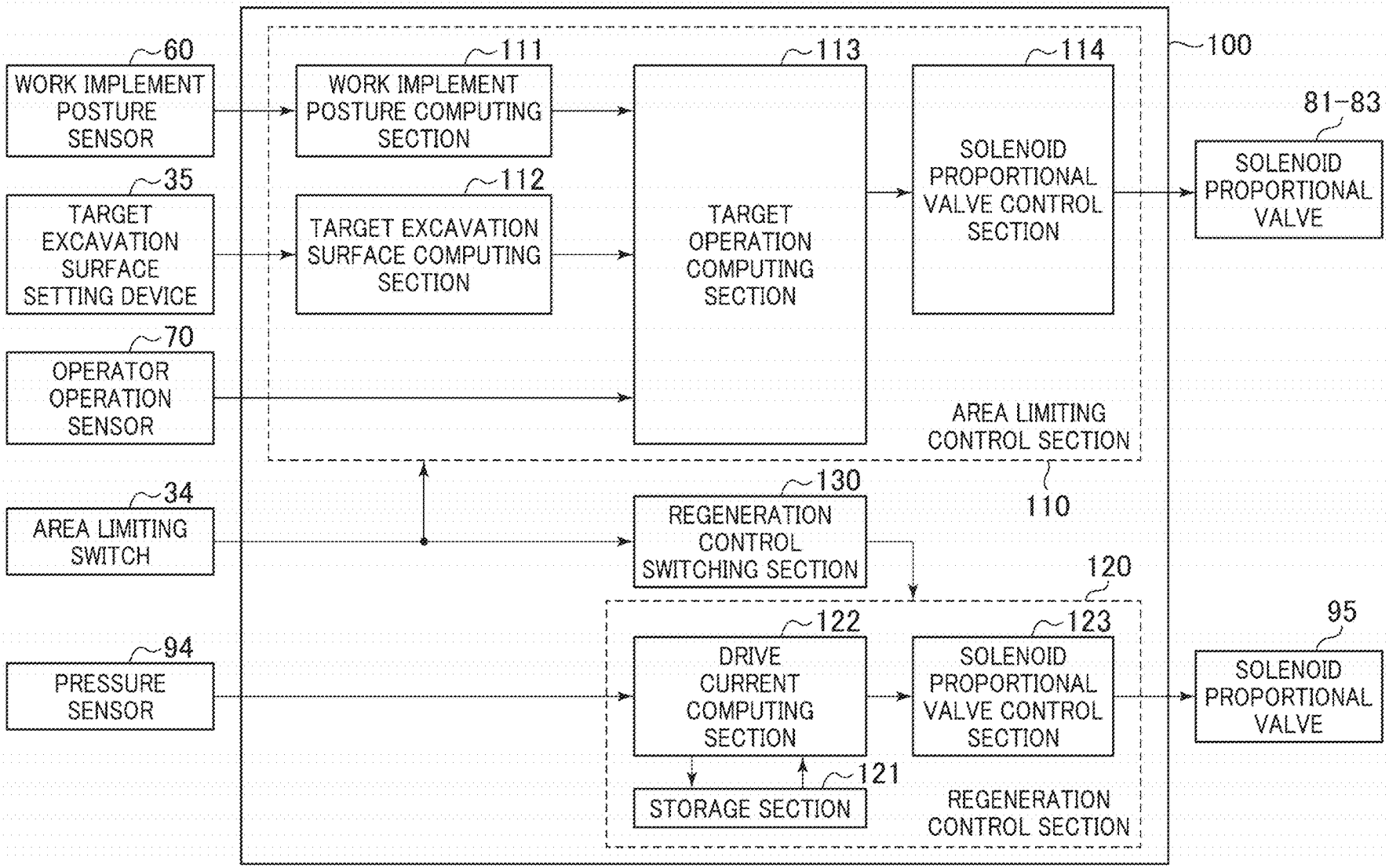
FIG. 3 is a functional block diagram illustrating the controller of FIG. 2.

FIG. 3 is a functional block diagram illustrating the controller 100. The controller 100 is equipped with an area limiting control section 110, a regeneration control section 120, and a regeneration control switching section 130. Connected to the controller 100 are a work implement posture sensor 60, a target excavation surface setting device 35, an operator operation sensor 70, and the solenoid proportional valves 81 through 83.

The work implement posture sensor 60 is composed of a boom angle sensor 61, an arm angle sensor 62, a bucket angle sensor 63, and a machine body inclination angle sensor 64.

The target excavation surface setting device 35 is an interface capable of inputting information related to the target excavation surface 200 (including positional information on the target excavation surface). The input to the target excavation surface setting device 35 may be manually effected by the operator, or the information may be taken in from the outside via a network or the like. Further, a satellite communications antenna may be connected to the target excavation surface setting device 35 to compute global coordinates of the excavator.

The operator operation sensor 70 is composed of the pressure sensors 71 through 73 gaining an pilot pressure generated through the operation of the operation levers 23 by the operator.

The area limiting control section 110 includes a work implement posture computing section 111, a target excavation surface computing section 112, a target operation computing section 113, and a solenoid proportional valve control section 114.

Figure 5:
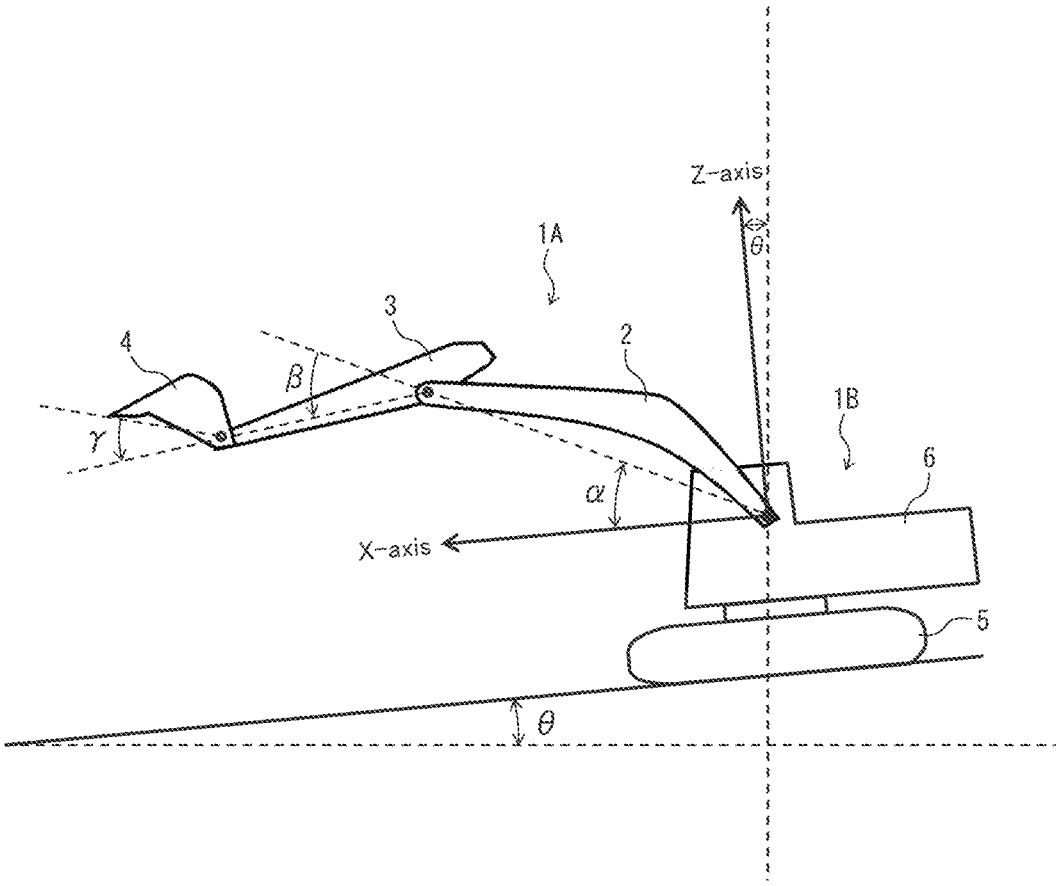
FIG. 5 is a diagram illustrating reference coordinates of the hydraulic excavator shown in FIG. 1.

The work implement posture computing section 111 computes the posture of the front work device 1A based on the information from the work implement posture sensor 60. The posture of the front work device 1A can be defined based on the excavator reference coordinates of FIG. 5. The excavator reference coordinates of FIG. 5 are coordinates set on the upper swing structure 6. The proximal end portion of the boom 2 rotatably supported by the upper swing structure 6 is used as the origin. The Z-axis is set in the vertical direction of the upper swing structure 6, and the X-axis is set in the horizontal direction thereof. The inclination angle of the boom 2 with respect to the X-axis is the boom angle $\alpha$, the inclination angle of the arm 3 with respect to the boom 2 is the arm angle $\beta$, and the inclination of the bucket 4 with respect to the arm 3 is the bucket angle $\gamma$. The inclination of the machine body 1B (upper swing structure 6) with respect to the horizontal surface (reference surface) is the inclination angle $\theta$. The boom angle $\alpha$ is detected by the boom angle sensor 61, the arm angle $\beta$ is detected by the arm angle sensor 62, the bucket angle $\gamma$ is detected by the bucket angle sensor 63, and the inclination angle $\theta$ is detected by the machine body inclination angle sensor 64. The boom angle $\alpha$ is maximum when the boom 2 is raised to the uppermost (when the boom cylinder 11 is at the stroke end in the raising direction, that is, when the boom cylinder length is maximum), and is minimum when the boom 2 is lowered to the lowermost (when the boom cylinder 11 is at the stroke end in the lowering direction, that is, when the boom cylinder length is minimum). The arm angle $\beta$ is minimum when the arm cylinder length is minimum, and is maximum when the arm cylinder length is maximum. The bucket angle $\gamma$ is minimum when the bucket cylinder length is minimum (in the state shown in FIG. 5), and is maximum when the bucket cylinder length is maximum.

Referring back to FIG. 3, a target excavation surface computing section 112 computes the target excavation surface 200 based on the information from the target excavation surface setting device 35. Based on the information from the work implement posture computing section 111, the target excavation surface computing section 112, and the operator operation sensor 70, a target operation computing section 113 computes the target operation of the front work device 1A such that the bucket 4 moves on the target excavation surface 200 or within the region above the surface. A solenoid proportional valve control section 114 computes a command to the solenoid proportional valves 81 through 83 based on a command from the target operation computing section 113. The solenoid proportional valves 81 through 83 are controlled based on a command from the solenoid proportional valve control section 114.

Figure 4:
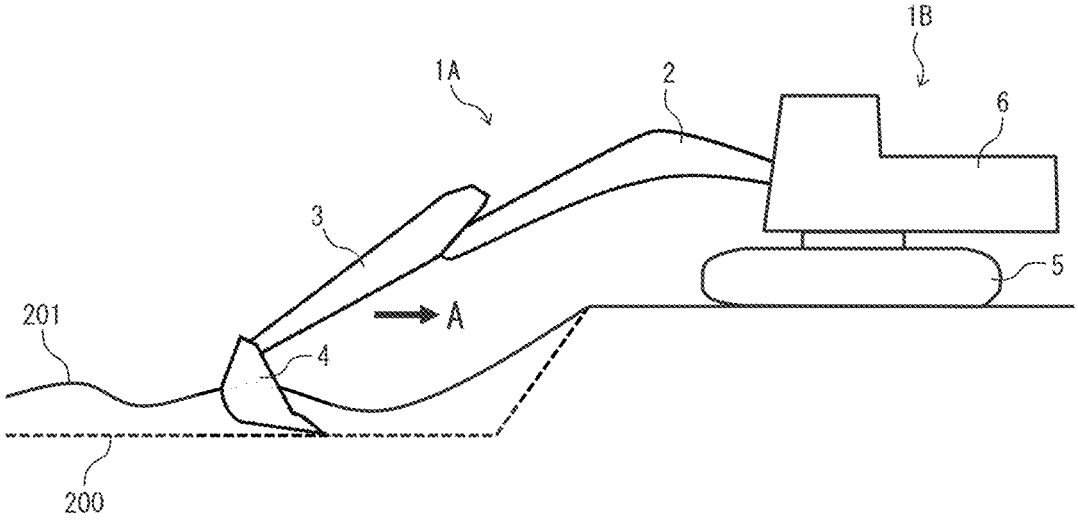
FIG. 4 is a diagram illustrating a horizontal excavation operation of the hydraulic excavator shown in FIG. 1.

FIG. 4 shows an example of a horizontal excavation operation through area limiting control. In the case where the operator operates the operation lever 23 to perform horizontal excavation through the arm 3 drawing operation in the direction of arrow A, the solenoid proportional valve 81*a* is controlled such that the claw tip of the bucket 4 does not intrude under the target excavation surface 200, and the boom raising operation is conducted automatically. Further, the operational speed of the arm 3 or the bucket 4 may be reduced by controlling the solenoid proportional valves 82*a*, 82*b*, 83*a*, and 83*b* such that the excavation speed or the excavation accuracy as required by the operator is attained. The control in which the operation amount of the operation lever 23 operated by the operator is thus corrected automatically or semi-automatically to thereby realize a desired operation of the driven member is generally referred to as machine control. The area limiting control in the present embodiment is a kind of machine control.

Figure 6:
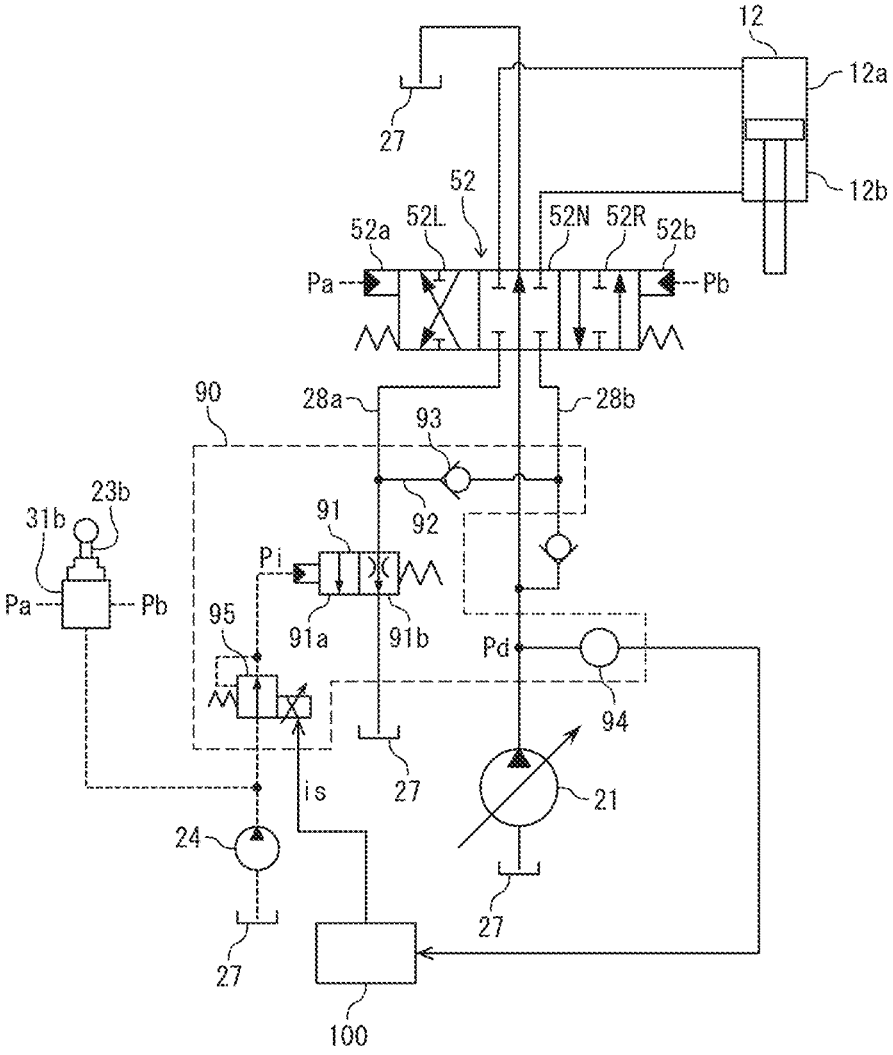
FIG. 6 is a detailed view of a regeneration circuit shown in FIG. 2.

Next, the regeneration circuit 90 of FIG. 2 will be described. FIG. 6 is a detailed view of the regeneration circuit 90.

In FIG. 6, the regeneration circuit 90 is equipped with a hydraulic operation type variable throttle 91 arranged in the tank side line 28*a* connecting the arm cylinder 12 and the tank 27 and controlling the flow rate of hydraulic fluid guided to the tank 27, a communication line 92 connecting the pump side line 28*b* and the tank side line 28*a*, a check valve 93 provided in the communication line 92 and permitting the flow of the hydraulic fluid from the tank side line 28*a* to the pump side line 28*b* when the pressure in the tank side line 28*a* is higher than the pressure in the pump side line 28*b* and preventing the flow of the hydraulic fluid from the pump side line 28*b* to the tank side line 28*a*, a pressure sensor 94 detecting a delivery pressure Pd of the hydraulic pump 21, and a solenoid proportional valve 95 outputting a pilot pressure Pi to the pilot section of the variable throttle 91.

The regeneration circuit 90 is controlled by a regeneration control section 120 (shown in FIG. 3) of the controller 100, and can increase the expansion/contraction speed of the arm cylinder 12 by causing the return fluid in the tank side line 28*a* of the arm cylinder 12 to flow into the pump side line 28*b*.

In FIG. 3, the regeneration control section 120 has a storage section 121 storing a relational function 121*a* (shown in FIG. 7) of the pump delivery pressure Pd and the drive current i for driving the solenoid proportional valve 95, a drive current computing section 122 obtaining the drive current i for driving the solenoid proportional valve 95 based on the pump delivery pressure Pd outputted from the pressure sensor 94 and the relational function 121*a*, and a solenoid proportional valve control section 123 outputting an operation signal is corresponding to the drive current obtained by the drive current computing section 122 to the solenoid proportional valve 95.

Figure 7:
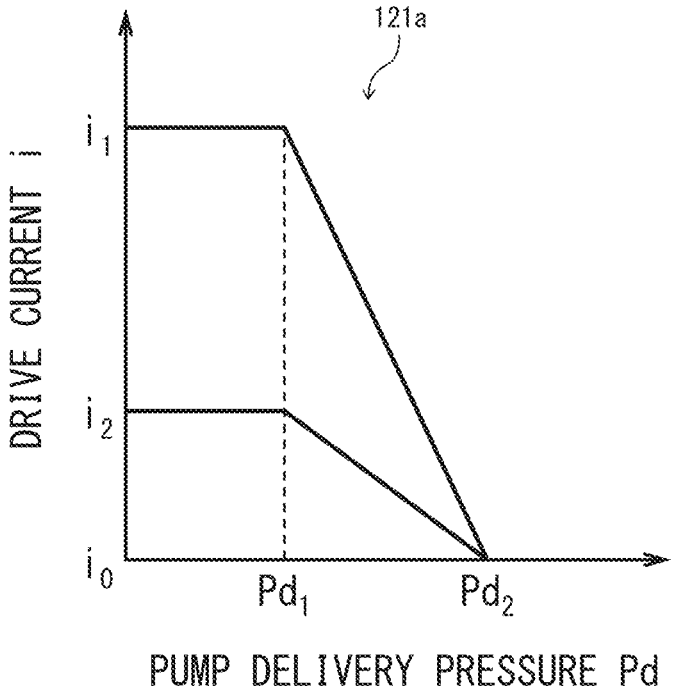
FIG. 7 is a diagram illustrating the relationship between the delivery pressure of a hydraulic pump and the drive current of a solenoid proportional valve.

FIG. 7 shows the relationship between the delivery pressure Pd of the hydraulic pump 21 and the drive current of the solenoid proportional valve 95. As shown in FIG. 7, in the relational function 121*a*, a maximum drive current i1 is associated with a pump delivery pressure Pd less than a first set pressure Pd1; a drive current i (i0<i<i1) decreasing in proportion to the pump delivery pressure Pd is associated with a pump delivery pressure Pd which is equal to or more than the first set pressure Pd1 and less than a second set pressure Pd2; and the minimum drive current i0 is associated with a pump delivery pressure Pd which is equal to or more than the second set pressure Pd2.

Figure 8A:
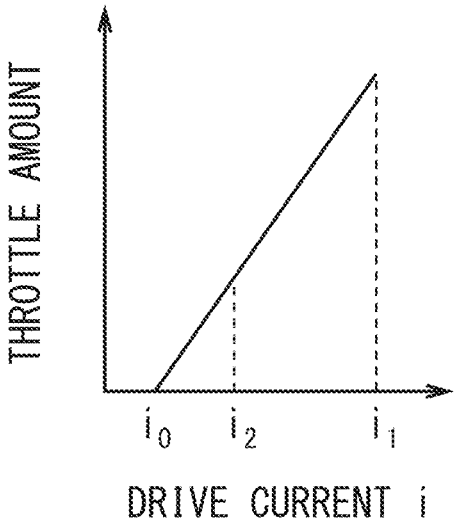
FIG. 8A is a diagram illustrating the relationship between the drive current of the solenoid proportional valve and the throttle amount of a variable throttle.
Figure 8B:
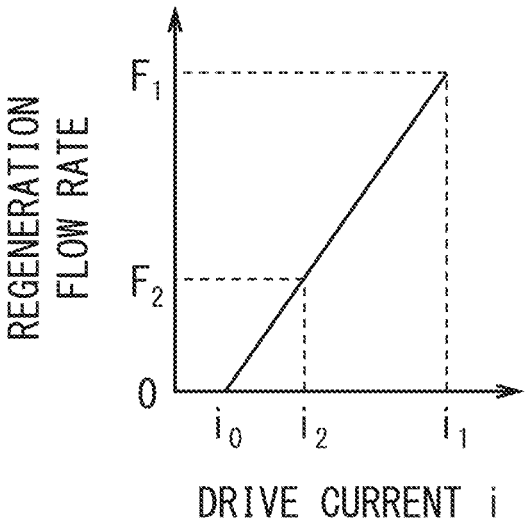
FIG. 8B is a diagram illustrating the relationship between the drive current of the solenoid proportional valve and the flow rate (regeneration flow rate) of the hydraulic fluid flowing into a pump side line from a tank side line.

FIG. 8A shows the relationship between the drive current i of the solenoid proportional valve 95 and the throttle amount of the variable throttle 91, and FIG. 8B shows the relationship between the drive current i of the solenoid proportional valve 95 and the flow rate of the hydraulic fluid flowing into the pump side line 28*b* from the tank side line 28*a* (regeneration flow rate). As shown in FIG. 8A, the throttle amount of the variable throttle 91 increases in proportion to the drive current i. As shown in FIG. 8B, the regeneration flow rate increases in proportion to the drive current i.

Next, the operation of the regeneration circuit 90 will be described.

In FIG. 6, when the right operation lever 23*b* is operated, for example, in the arm drawing direction, a pilot pressure Pa is generated, and this pilot pressure Pa acts on a pilot section 52*a* situated on the left side of the flow control valve 52, and the flow control valve 52 is switched from a neutral position 52N to a left side switching position 52L. As a result, the hydraulic fluid delivered from the hydraulic pump 21 is supplied to a bottom side chamber 12*a* of the arm cylinder 12 via the pump side line 28*b* and the left side switching position 52L of the flow control valve 52, and the return fluid from the rod side chamber 12*b* is restored to the tank 27 via the left side switching position 52L of the flow control valve 52, the tank side line 28*a*, and the variable throttle 91.

At this time, while the pump delivery pressure Pd detected by the pressure sensor 94 is lower than the first set pressure Pd1 of the relational function 121*a* (shown in FIG. 7) stored in the storage section 121 (shown in FIG. 3) of the controller 100, a high and fixed drive current (i=i1) is obtained by the drive current computing section 122, and an operation signal (is=i1) corresponding to this drive current (i=i1) is outputted from the solenoid proportional valve control section 123 of the regeneration control section 120 to the pilot section of the solenoid proportional valve 95. As a result, the pilot pressure Pi outputted from the solenoid proportional valve 95 is minimum, and the variable throttle 91 is maintained at the throttle position 91*b* where the throttle amount is maximum by the urging force of a spring, and a pressure in accordance with the throttle amount of the variable throttle 91 is generated in the tank side line 28*a*. When the pressure inside this tank side line 28*a* exceeds the pressure of the pump side line 28*b*, a part of the return fluid from the rod side chamber 12*b* of the arm cylinder 12 flows to the pump side line 28*b* via the communication line 92 and the check valve 93, and this return fluid joins the hydraulic fluid delivered from the hydraulic pump 21 and is supplied to the bottom side chamber 12*a* of the arm cylinder 12. At this time, the flow rate of the fluid flowing into the bottom side chamber 12*a* of the arm cylinder 12 increases by the maximum regeneration flow rate shown in FIG. 8B having flowed into from the communication line 92, and the expansion speed of the arm cylinder 12 increases accordingly.

As described above, when, from the state where the regeneration flow rate is maximum, the load on the arm cylinder 12 increases due to the resistance of earth and sand or the like abutting the bucket forward end, the delivery pressure Pd of the hydraulic pump 21 increases. When the value of this pump delivery pressure Pd is between the first set pressure Pd1 and the second set pressure Pd2 of the relational function 121*a* of FIG. 3, the drive current i obtained by the drive current computing section 122 of the regeneration control section 120 assumes the following value: i0<i<i1, and the operation signal 'is' outputted from the solenoid proportional valve control section 123 of the regeneration control section 120 assumes the following value: i0<is=i<i1, whereby the value of the pilot pressure Pi outputted from the solenoid proportional valve 95 increases, the variable throttle 91 is driven so as to be reduced in throttle amount (so as to be increased in opening degree) as shown in FIG. 8A, and the amount of hydraulic fluid returned to the tank 27 increases, with the regeneration flow rate being reduced as shown in FIG. 8B. At this time, although the expansion/contraction speed of the arm cylinder 12 decreases, the pressure of the tank side line 28*a* decreases, and the pressure of the rod side chamber 12*b* of the arm cylinder 12 is reduced, whereby it is possible to attain a large thrust.

When the claw tip of the bucket 4 is engaged in the earth and sand, and the value of the pump delivery pressure Pd becomes equal to or more than the second set pressure Pd2 of the relational function 121*a* (shown in FIG. 7), the drive current i obtained by the drive current computing section 122 of the regeneration control section 120 is as follows: i=i0, and also the operation signal 'is' outputted from the solenoid proportional valve control section 123 is as follows: is=i=i0. As a result, the value of the pilot pressure Pi outputted from the solenoid proportional valve 95 is maximum, and the variable throttle 91 is switched to the communication position 91*a* where the throttle amount is zero (totally open). As a result, the regeneration flow rate becomes zero, and there is attained a regeneration canceling state in which the total amount in the tank side line 28*a* is restored to the tank 27. In this way, the throttle amount of the variable throttle 91 is adjusted in accordance with an increase in the pump delivery pressure Pd, whereby it is possible to continue the work without stopping the operation of the arm 3.

As shown in FIG. 6, in the present embodiment, there is provided the pressure sensor 94 detecting the delivery pressure Pd of the hydraulic pump 21, and, based on the pump delivery pressure Pd outputted from the pressure sensor 94, the regeneration operation and the regeneration canceling operation are conducted. This, however, should not be construed restrictively. For example, a pressure sensor detecting a load pressure may be provided in a main line situated between the flow control valve 52 and the arm cylinder 12, and, based on a pressure signal outputted from the pressure sensor, the regeneration operation and the regeneration canceling operation may be conducted. While in the present embodiment described above hydraulic fluid regeneration is effected on the arm crowding side (the side where the arm cylinder 12 expands), the same description is also applicable to the arm dumping side (the side where the arm cylinder 12 contracts). Further, as shown in FIGS. 2 and 6, in the present embodiment, the regeneration circuit 90 is applied to the arm cylinder 12, this should not be construed restrictively. It can also be applied to the other hydraulic actuators (the boom cylinder 11 or the bucket cylinder 13).

In the hydraulic excavator 1 constructed as described above, in the case, for example, where hydraulic fluid regeneration is effected in the arm cylinder 12 during the horizontal excavation operation under area limiting control, the operational speed of the arm 3 fluctuates, so that there is a fear of the claw tip of the bucket 4 being engaged deeper in the ground than the target excavation surface 200. In view of this, in order to suppress fluctuation in the speed of the arm cylinder 12 accompanying the hydraulic fluid regeneration during the execution of the arm limiting control, the controller 100 of the present embodiment is equipped with a regeneration control switching section 130 for restricting the regeneration flow rate in the arm cylinder 12.

In FIG. 3, the regeneration control switching section 130 gives a designation to the regeneration control section 120 so as to change the upper limit value of the regeneration flow rate based on the switching signal from the area limiting switch 34.

Figure 9:
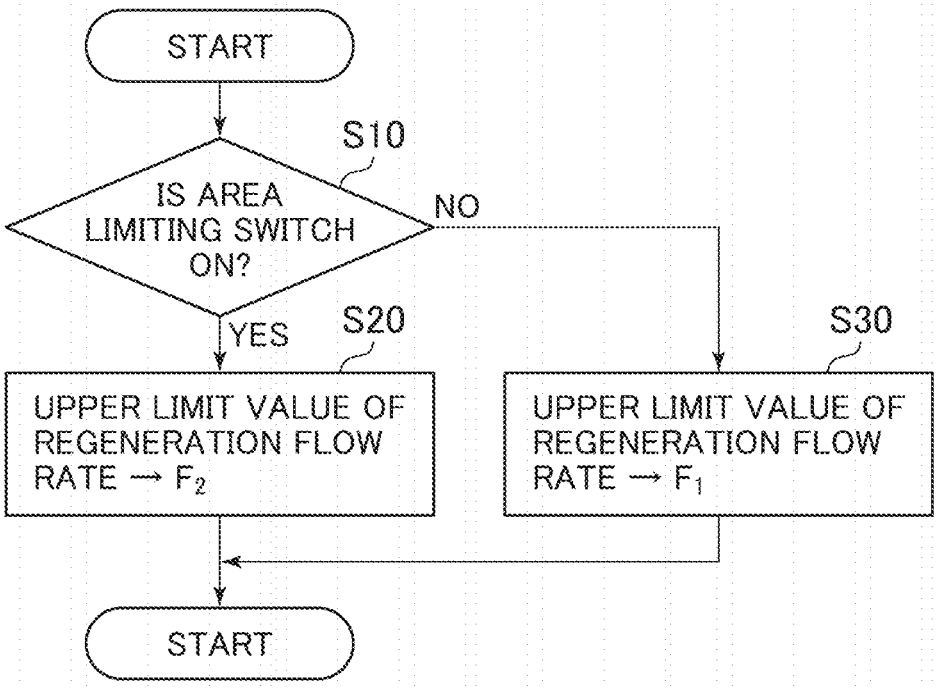
FIG. 9 is a flowchart illustrating the processing of a regeneration control switching section shown in FIG. 4.

FIG. 9 is a flowchart illustrating the processing of the regeneration control switching section 130. In the following, the steps will be described one by one.

First, the regeneration control switching section 130 determines whether or not the area limiting switch 34 is at the ON position (step S10).

In the case where it is determined in step S10 that the area limiting switch 34 is at the ON position (YES), designation is given to the regeneration control section 120 so as to set the upper limit value of the regeneration flow rate to the second set value F2 (shown in FIG. 8B) which is smaller than the first set value F1 (step S20). From this onward, as shown in FIG. 7, the regeneration control section 120 adjusts the drive current between i0 and i2 in accordance with the pump delivery pressure Pd, and adjusts the regeneration flow rate between zero and the second upper limit value F2. The second set value F2 is set to a value of zero or more. As a result, during the execution of the area limiting control, the regeneration flow rate in the arm cylinder 12 is limited. Here, in the case where the second set value F2 is set to zero, the regeneration flow rate in the arm cylinder 12 is always zero independently of the pump delivery pressure Pd, and hydraulic fluid regeneration is disabled.

On the other hand, in the case where it is determined in step S10 that the area limiting switch 34 is not at the ON position (NO), designation is given to the regeneration control section 120 so as to set the upper limit value of the regeneration flow rate to the first set value F1 (step S20). As a result, during non-execution of the area limiting control, the regeneration flow rate in the arm cylinder 12 is not limited.

In the present embodiment, the case where the area limiting switch 34 is at the OFF position (that is, during non-execution of the area limiting control) is defined as "the case where the function of the area limiting control section 110 is invalid," and the case where the area limiting switch 34 is at the ON position (that is, during execution of the area limiting control) is defined as "the case where the function of the area limiting control section 110 is effective."

In the hydraulic excavator 1 according to the present embodiment, in the case where the function of the area limiting control section 110 is effective (that is, during execution of the area limiting control), the regeneration flow rate in the arm cylinder 12 is limited, whereby the fluctuation in the speed of the arm cylinder 12 is suppressed, so that it is possible to secure the control accuracy in the area limiting control. On the other hand, in the case where the function of the area limiting control section 110 is invalid (that is, during non-execution of the area limiting control), the expansion/contraction speed of the arm cylinder 12 is increased, with the regeneration flow rate not being limited, so that it is possible to improve work efficiency in a work not involving the area limiting control.

Embodiment 2

Figure 10:
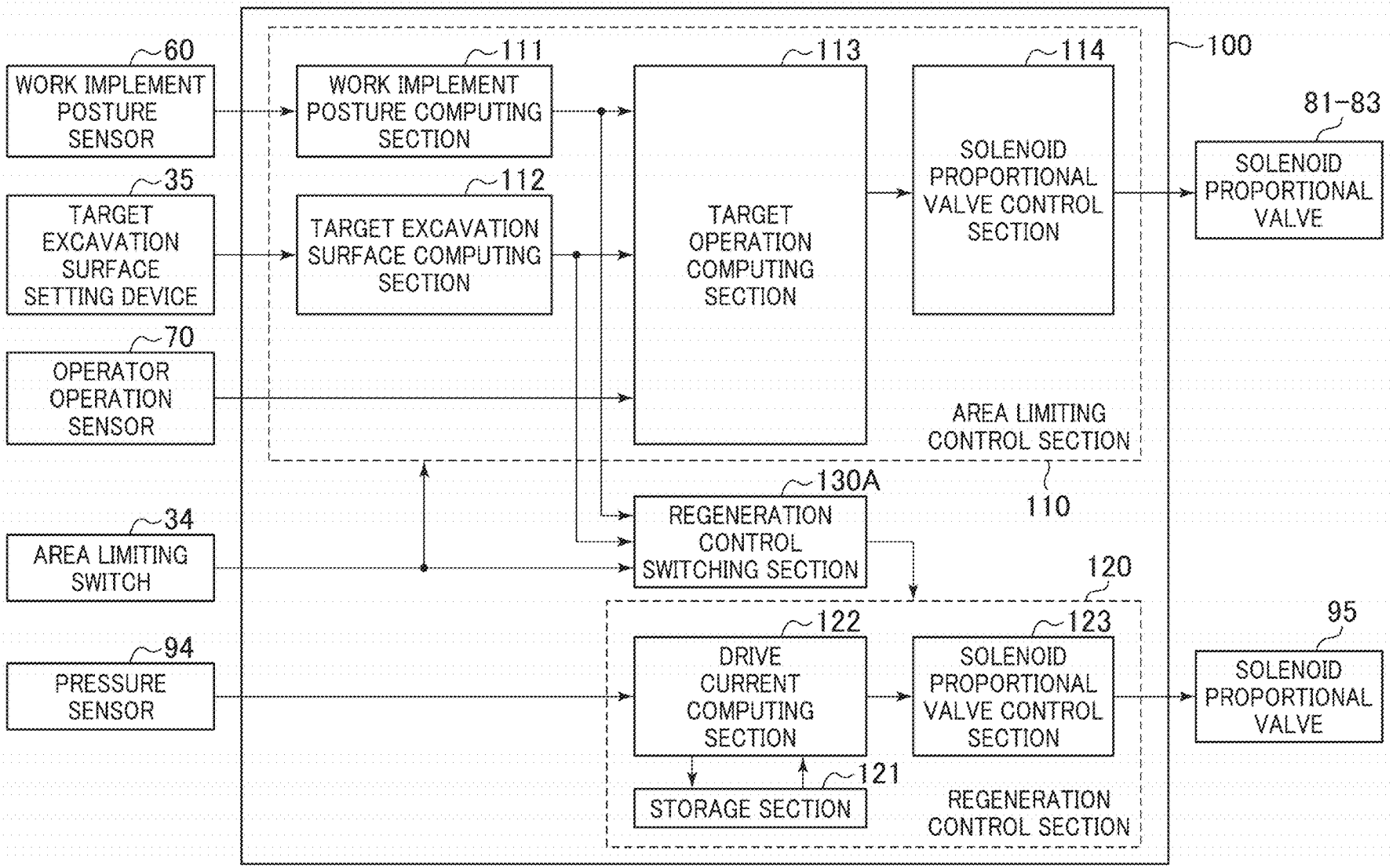
FIG. 10 is a functional block diagram illustrating a controller with which a hydraulic excavator according to a second embodiment of the present invention is equipped.
Figure 11:
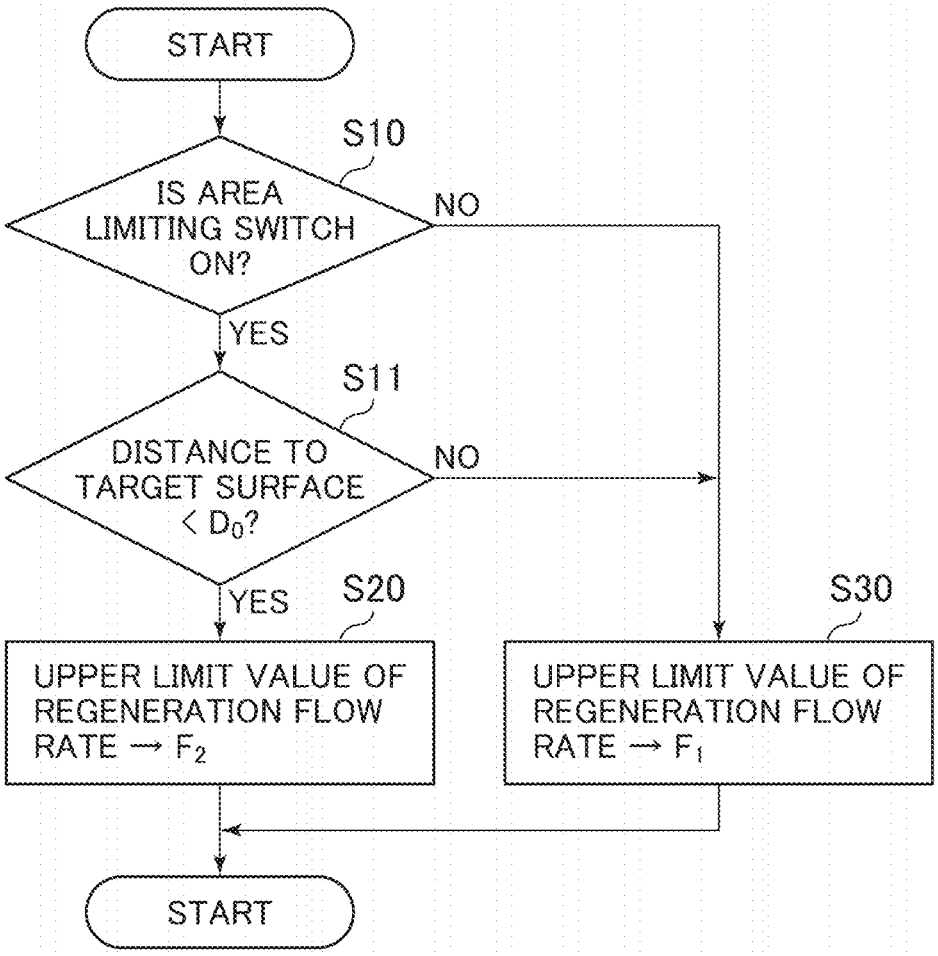
FIG. 11 is a flowchart illustrating the processing of a regeneration control switching section shown in FIG. 10.

The hydraulic excavator 1 according to the second embodiment of the present invention will be described with reference to FIGS. 10 and 11. FIG. 10 is a functional block diagram illustrating the controller 100 with which the hydraulic excavator 1 according to the present embodiment is equipped, and FIG. 11 is a flowchart illustrating the processing of a regeneration control switching section 130A shown in FIG. 10.

In the hydraulic excavator 1 according to the first embodiment, in the case where the area limiting switch 34 is at the ON position (that is, during the execution of the area limiting control), the regeneration flow rate in the arm cylinder 12 is limited. However, even during the execution of the area limiting control, in the case where the bucket 4 is greatly spaced away from the target excavation surface 200, there is no fear of the claw tip of the bucket 4 being engaged deeper in the ground than the target excavation surface 200 even if the operational speed of the arm 3 fluctuates with the hydraulic fluid regeneration in the arm cylinder 12.

In the hydraulic excavator 1 according to the present embodiment, in the case where the area limiting control is being executed and where the distance from the claw tip position of the bucket 4 to the target excavation surface 200 is equal to or more than a predetermined distance (in the case where the claw tip of the bucket 4 is outside, for example, the finishing area to be excavated), the expansion/contraction speed of the arm cylinder 12 is increased without limiting the regeneration flow rate, thereby improving work efficiency in a work involving the area limiting control while securing the control efficiency of the area limiting control.

In FIG. 10, the difference of the present embodiment from the first embodiment (shown in FIG. 3) is that the regeneration control switching section 130 issues an order to the regeneration control section 120 to change the upper limit value of the regeneration flow rate based on the switching signal from the area limiting switch 34, the work implement posture information inputted from the work implement posture computing section 111, and the target excavation surface information inputted from the target excavation surface computing section 112.

In FIG. 11, the difference of the present embodiment from the first embodiment (shown in FIG. 9) is that in the case where it is determined in step S10 that the area limiting switch 34 is at the ON position (YES), it is determined whether or not the distance from the claw tip position of the bucket 4 to the target excavation surface 200 is smaller than a predetermined distance D0 (step S11). In the case where it is determined that it is smaller than the predetermined distance D0 (YES), an order is issued to the regeneration control section 120 to set the upper limit value of the regeneration flow rate to the second set value F2 (step S20). In the case where it is determined that it is not smaller than the predetermined distance D0 (NO), an order is issued to the regeneration control section 120 to set the upper limit value of the regeneration flow rate to the first set value F1 (step S30).

In the present embodiment, the case where the area limiting switch 34 is at the OFF position or the case where the area limiting switch 34 is at the ON position and where the distance from the claw tip position of the bucket 4 to the target excavation surface 200 is not smaller than the predetermined distance D0 (that is, the case where the effect of the area limiting control is not conspicuous) is defined as "the case where the function of the area limiting control section 110 is invalid," and the case where the area limiting switch 34 is at the ON position and where the distance from the claw tip position of the bucket 4 to the target excavation surface 200 is smaller than the predetermined distance D0 (that is, the case where the effect of the area limiting control is conspicuous) is defined as "the case where the function of the area limiting control section 110 is effective."

Also in the hydraulic excavator 1 according to the present embodiment, it is possible to attain the same effect as that of the first embodiment.

Further, in the hydraulic excavator 1 according to the present embodiment, in the case where the function of the area limiting control section 110 is effective (that is, in the case where the area limiting control is being executed and where the distance from the claw tip position of the bucket 4 to the target excavation surface 200 is equal to or more than the predetermined distance D0 (the case where the claw tip of the bucket 4 is, for example, outside the finishing area to be excavated)), the expansion speed of the arm cylinder 12 is increased without limiting the regeneration flow rate. As a result, it is possible to improve work efficiency in a work involving the area limiting control while securing the control accuracy of the area limiting control.

Embodiment 3

Figure 12:
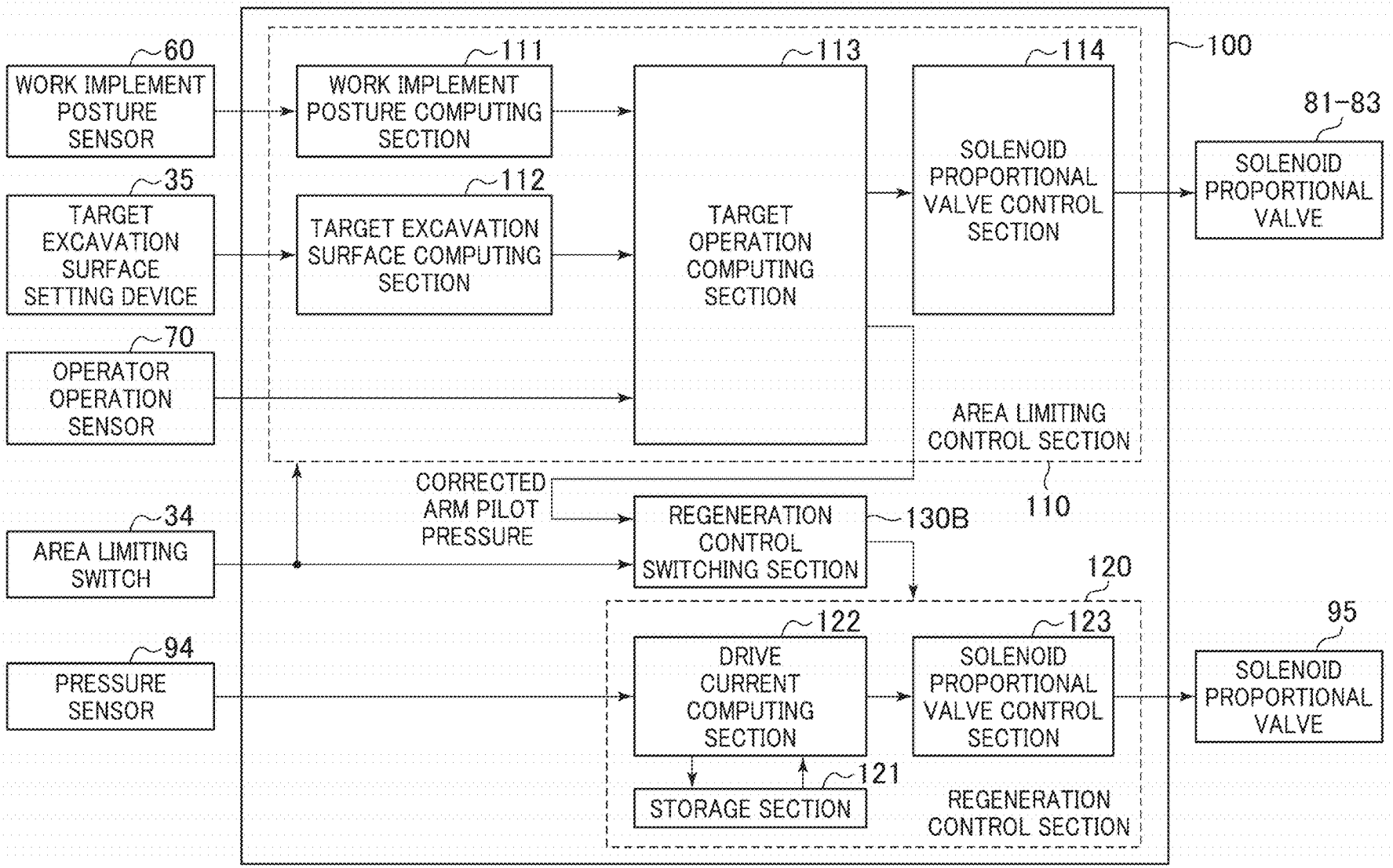
FIG. 12 is a functional block diagram illustrating a controller with which a hydraulic excavator according to a third embodiment of the present invention is equipped.
Figure 13:
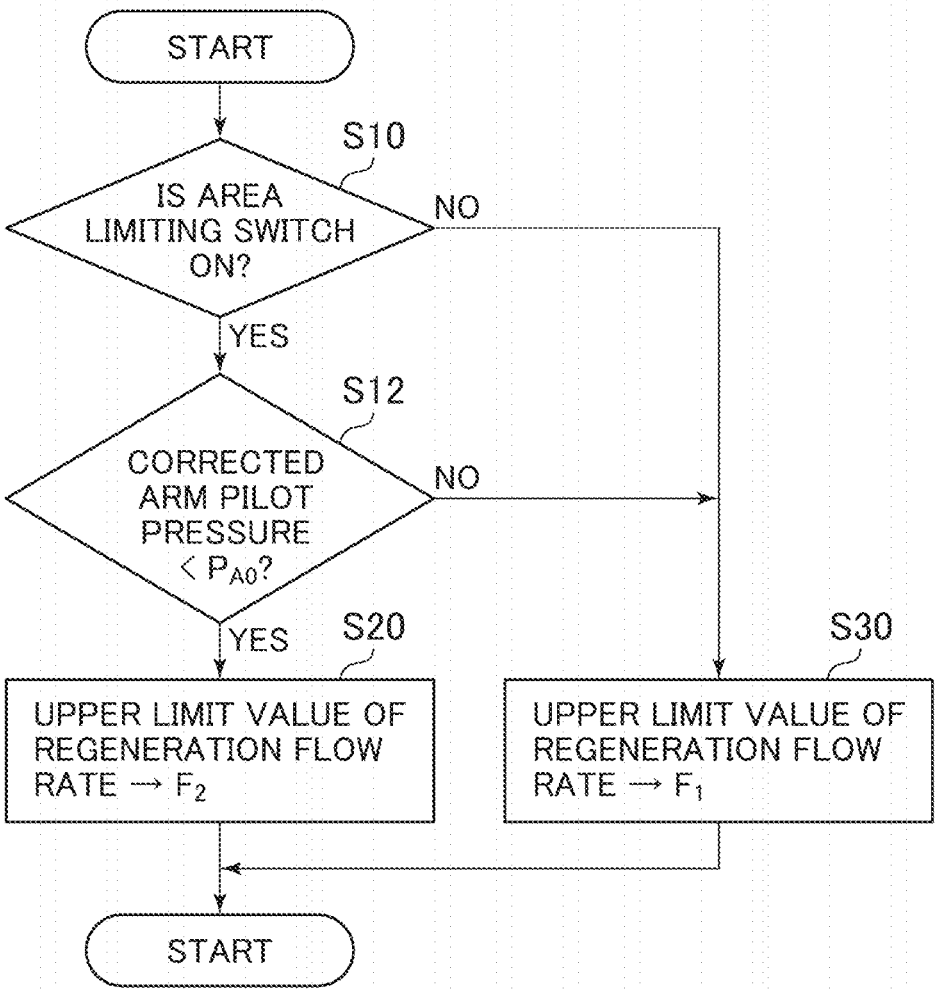
FIG. 13 is a flowchart illustrating the processing of a regeneration control switching section shown in FIG. 12.

The hydraulic excavator 1 according to the third embodiment of the present invention will be described with reference to FIGS. 12 and 13. FIG. 12 is a functional block diagram illustrating the controller 100 with which the hydraulic excavator 1 according to the present embodiment is equipped, and FIG. 13 is a flowchart illustrating the processing of a regeneration control switching section 130B shown in FIG. 12.

In the hydraulic excavator 1 according to the first embodiment, in the case where the area limiting switch 34 is at the ON position (that is, during the execution of the area limiting control), the regeneration flow rate in the arm cylinder 12 is limited. Here, in the case where the distance from the claw tip position of the bucket 4 to the target excavation surface 200 is small during the execution of the area limiting control, in order to secure the control accuracy, pressure reduction (correction) is effected via the solenoid proportional valves 82*a* and 82*b* such that the pilot pressure of the pilot lines 42*a* and 42*b* (the arm pilot pressure) is lower than a predetermined pilot pressure, and the operational speed of the arm 3 is limited. That is, the arm pilot pressure corrected by the solenoid proportional valves 82*a* and 82*b* (referred to, in the following, as the "corrected arm pilot pressure") is equal to or more than a predetermined pilot pressure only in the case where the bucket 4 is greatly spaced away from the target excavation surface 200. Thus, in the case where the area limiting control is being executed and where the corrected arm pilot pressure is equal to or more than the predetermined pilot pressure, even if the operational speed of the arm 3 fluctuates with the hydraulic fluid regeneration in the arm cylinder 12, there is no fear of the claw tip of the bucket 4 being engaged deeper in the ground than the target excavation surface 200.

In the hydraulic excavator 1 according to the present embodiment, in the case where the area limiting control is being executed and where the corrected arm pilot pressure is equal to or more than a predetermined pilot pressure, the expansion/contraction speed of the arm cylinder 12 is increased without limiting the regeneration flow rate, whereby improving work efficiency of a work involving the limiting control while securing the control accuracy due to the area limiting control.

In FIG. 12, the difference of the present embodiment from the first embodiment (shown in FIG. 3) is that the regeneration control switching section 130B issues an order to the regeneration control section 120 to change the upper limit value of the regeneration flow rate based on the switching signal from the area limiting switch 34 and the corrected arm pilot pressure from the target operation computing section 113.

In FIG. 13, the difference of the present embodiment from the first embodiment (shown in FIG. 9) is that in the case where it is determined in step S10 that the area limiting switch 34 is at the ON position (YES), it is determined whether or not the corrected arm pilot pressure is lower than a predetermined pilot pressure PA0 (step S12). In the case where it is determined that it is lower than the predetermined pilot pressure PA0 (YES), an order is issued to the regeneration control section 120 to set the upper limit value of the regeneration flow rate to the second set value F2 (step S20), and in the case where it is determined that it is not lower than the predetermined pilot pressure PA0 (NO), an order is issued to the regeneration control section 120 to set the upper limit value of the regeneration flow rate to the first set value F1 (step S30).

In the present embodiment, the case where the area limiting switch 34 is at the OFF position or the case where the area limiting switch 34 is at the ON position and where the corrected arm pilot pressure is not lower than the predetermined pilot pressure PA0 (that is, the case where the effect of the area limiting control is not conspicuous) is defined as "the case where the function of the area limiting control section 110 is invalid," and the case where the area limiting switch 34 is at the ON position and where the corrected arm pilot pressure is lower than the predetermined pilot pressure PA0 (that is, the case where the effect of the area limiting control is conspicuous) is defined as "the case where the function of the area limiting control section 110 is effective."

Also in the hydraulic excavator 1 according to the present embodiment, it is possible to achieve the same effect as that of the first embodiment.

Further, in the hydraulic excavator 1 according to the present embodiment, in the case where the function of the area limiting control section 110 is effective (that is, in the case where the area limiting control is being executed and where the corrected arm pilot pressure is equal to or more than the predetermined pilot pressure PA0 (in the case where the bucket 4 is to be regarded as greatly spaced away from the target excavation surface 200)), the expansion speed of the arm cylinder 12 increases without the regeneration flow rate being limited. As a result, it is possible to improve work efficiency in a work involving the area limiting control while securing the control accuracy in the area limiting control.

While in the present embodiment the corrected arm pilot pressure is gained from the target operation computing section 113, pressure sensors may be provided between the solenoid proportional valve 82*a* of the pilot line 42*a* and the pilot section 52*a* and between the solenoid proportional valve 82*b* of the pilot line 42*b* and the pilot section 52*b*, thereby detecting the corrected arm pilot pressure.

Embodiment 4

Figure 14:
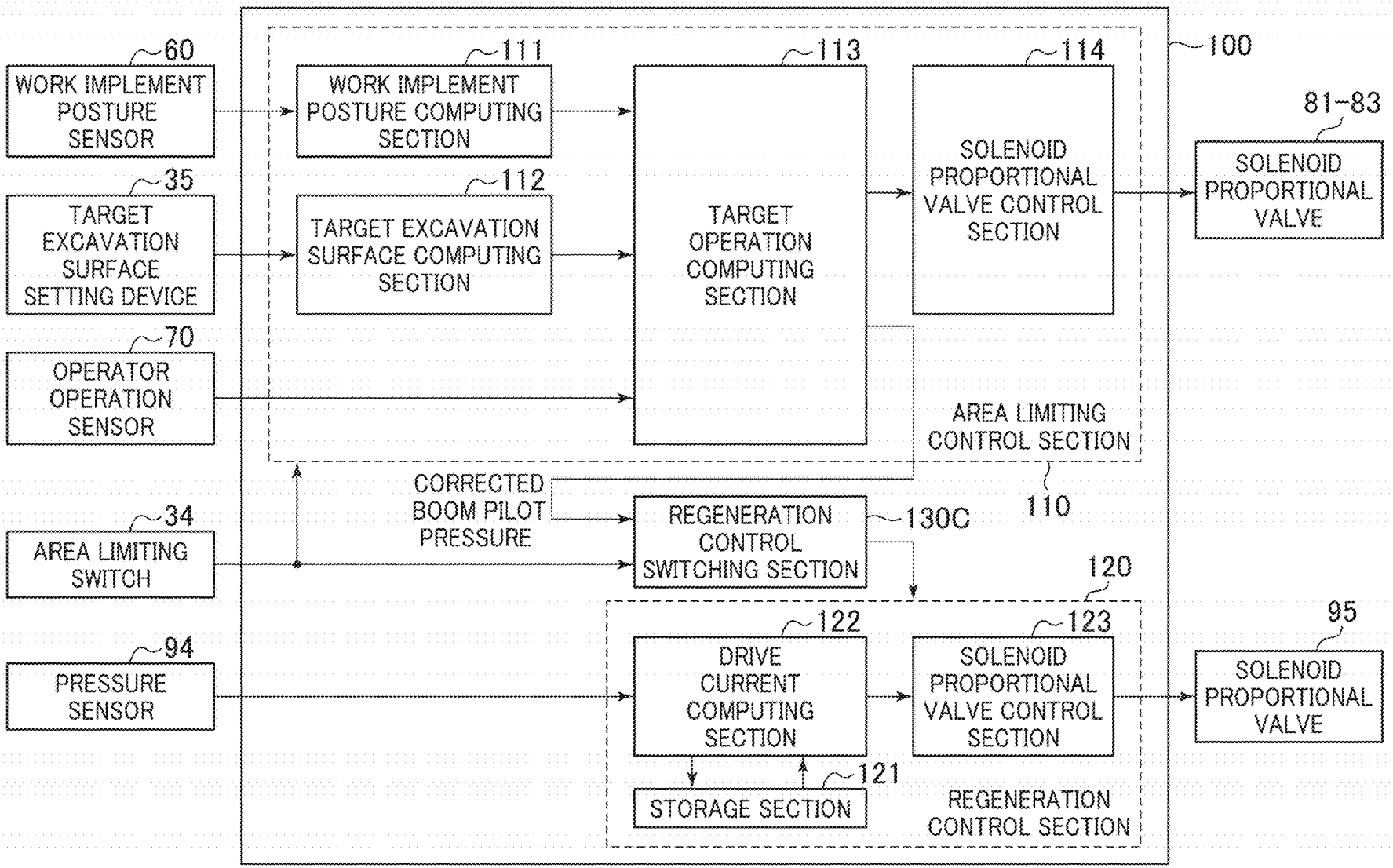
FIG. 14 is a functional block diagram illustrating a controller with which a hydraulic excavator according to a fourth embodiment of the present invention is equipped.
Figure 15:
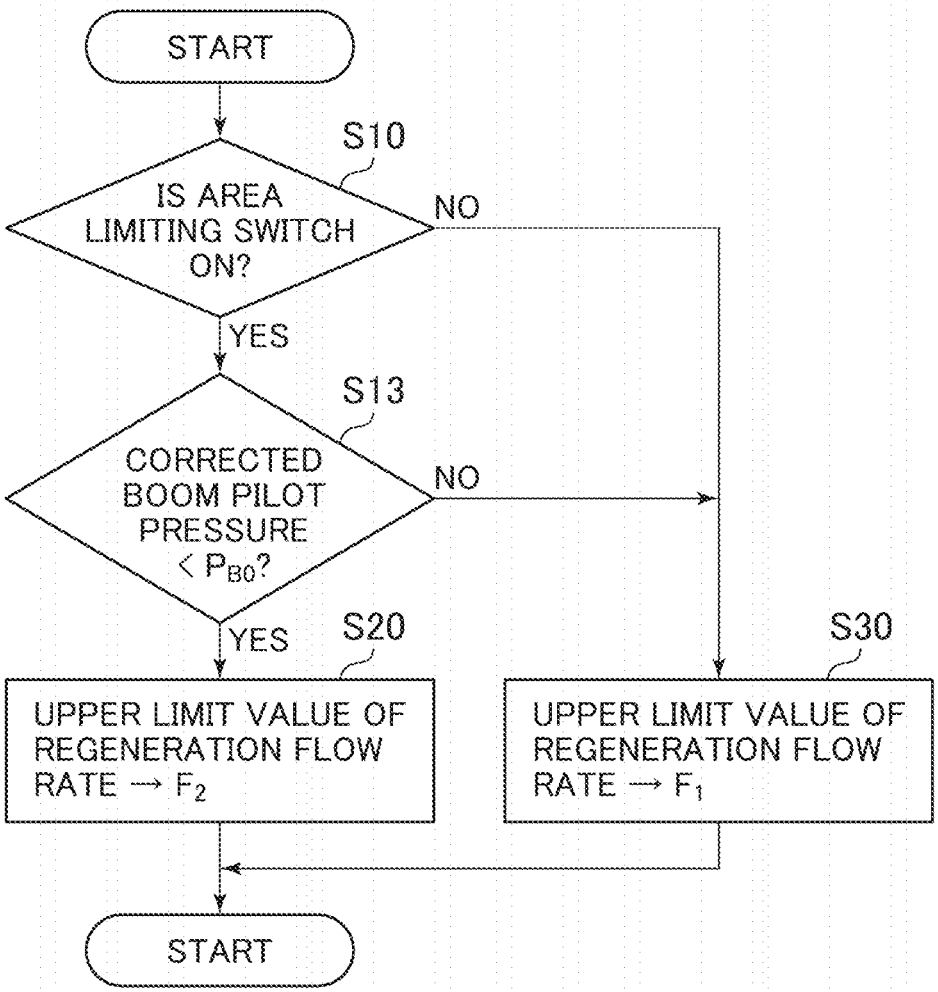
FIG. 15 is a flowchart illustrating the processing of a regeneration control switching section shown in FIG. 14.

The hydraulic excavator 1 according to the fourth embodiment of the present invention will be described with reference to FIGS. 14 and 15. FIG. 14 is a functional block diagram illustrating the controller 100 with which the hydraulic excavator 1 according to the present embodiment is equipped, and FIG. 15 is a flowchart illustrating the processing of a regeneration control switching section 130C shown in FIG. 14.

In the hydraulic excavator 1 according to the first embodiment, in the case where the area limiting switch 34 is at the ON position (that is, during execution of the area limiting control), the regeneration flow rate in the arm cylinder 12 is limited. Here, in the case where, during the execution of the area limiting control, the distance from the claw tip position of the bucket 4 to the target excavation surface 200 is small, the corrected boom raising pressure generated by the solenoid proportional valve 81*a* and the corrected boom lowering pressure generated by the solenoid proportional valve 81*b* are both equal to or less than a predetermined pilot pressure. Thus, in the case where the area limiting control is being executed and where the corrected boom raising pilot pressure or the corrected boom lowering pilot pressure (hereinafter collectively referred to as "the corrected boom pilot pressure") is equal to or more than a predetermined pilot pressure, even if the operational speed of the arm 3 fluctuates with the hydraulic fluid regeneration in the arm cylinder 12, there is no fear of the claw tip of the bucket 4 being engaged deeper in the ground than the target excavation surface 200.

In the hydraulic excavator 1 according to the present embodiment, in the case where the area limiting control is being executed and where the corrected boom pilot pressure is equal to or more than a predetermined pilot pressure, the expansion/contraction speed of the arm cylinder 12 is increased without limiting the regeneration flow rate, whereby it is possible to improve work efficiency in a work involving the area limiting control while securing the control accuracy of the area limiting control.

In FIG. 14, the difference of the present embodiment from the first embodiment (shown in FIG. 3) is that the regeneration control switching section 130C issues an order to the regeneration control section 120 to change the upper limit value of the regeneration flow rate based on the switching signal from the area limiting switch 34 and the corrected boom pilot pressure from the target operation computing section 113.

In FIG. 15, the difference of the present embodiment from the first embodiment (shown in FIG. 9) is that in the case where it is determined in step S10 that the area limiting switch 34 is at the ON position (YES), it is determined whether or not the corrected boom pilot pressure is lower than a predetermined pilot pressure PB0 (step S13). In the case where it is determined that it is lower than the predetermined pilot pressure PB0 (YES), an order is issued to the regeneration control section 120 to set the upper limit value of the regeneration flow rate to the second set value F2 (step S20), and in the case where it is determined that it is not lower than the predetermined pilot pressure PB0 (NO), an order is issued to the regeneration control section 120 to set the upper limit value of the regeneration flow rate to the first set value F1 (step S30).

In the present embodiment, the case where the area limiting switch 34 is at the OFF position or the case where the area limiting switch 34 is at the ON position and where the corrected boom pilot pressure is not lower than the predetermined pilot pressure PB0 (that is, the case where the effect of the area limiting control is not conspicuous) is defined as "the case where the function of the area limiting control section 110 is invalid," and the case where the area limiting switch 34 is at the ON position and where the corrected boom pilot pressure is lower than the predetermined pilot pressure PB0 (that is, the case where the effect of the area limiting control is conspicuous) is defined as "the case where the function of the area limiting control section 110 is effective."

Also in the hydraulic excavator 1 according to the present embodiment, it is possible to achieve the same effect as that of the first embodiment.

Further, in the hydraulic excavator 1 according to the present embodiment, in the case where the function of the area limiting control section 110 is effective (that is, in the case where the area limiting control is being executed and where the corrected boom pilot pressure is equal to or more than the predetermined pilot pressure PB0 (in the case where the bucket 4 is to be regarded as greatly spaced away from the target excavation surface 200), the expansion speed of the arm cylinder 12 increases without the regeneration flow rate being limited. As a result, it is possible to improve work efficiency in a work involving the area limiting control while securing the control accuracy in the area limiting control.

While in the present embodiment the corrected boom pilot pressure is gained from the target operation computing section 113, pressure sensors may be provided between the shuttle valve 26 of the pilot line 41*a* and the pilot section 51*a* and between the solenoid proportional valve 81*b* of the pilot line 41*b* and the pilot section 51*b*, thereby detecting the corrected boom pilot pressure.

Embodiment 5

Figure 16:
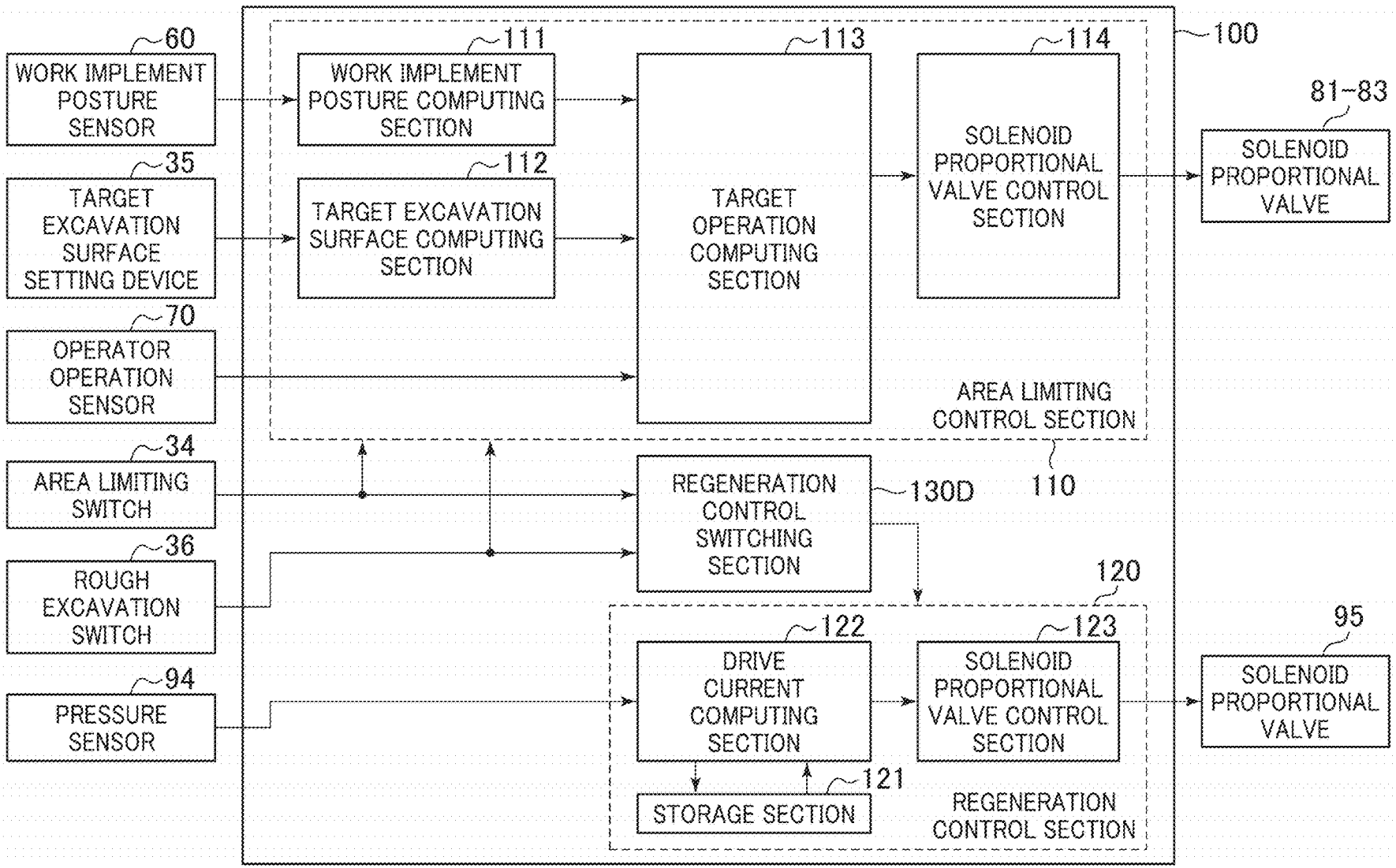
FIG. 16 is a functional block diagram illustrating a controller with which a hydraulic excavator according to a fifth embodiment of the present invention is equipped.
Figure 17:
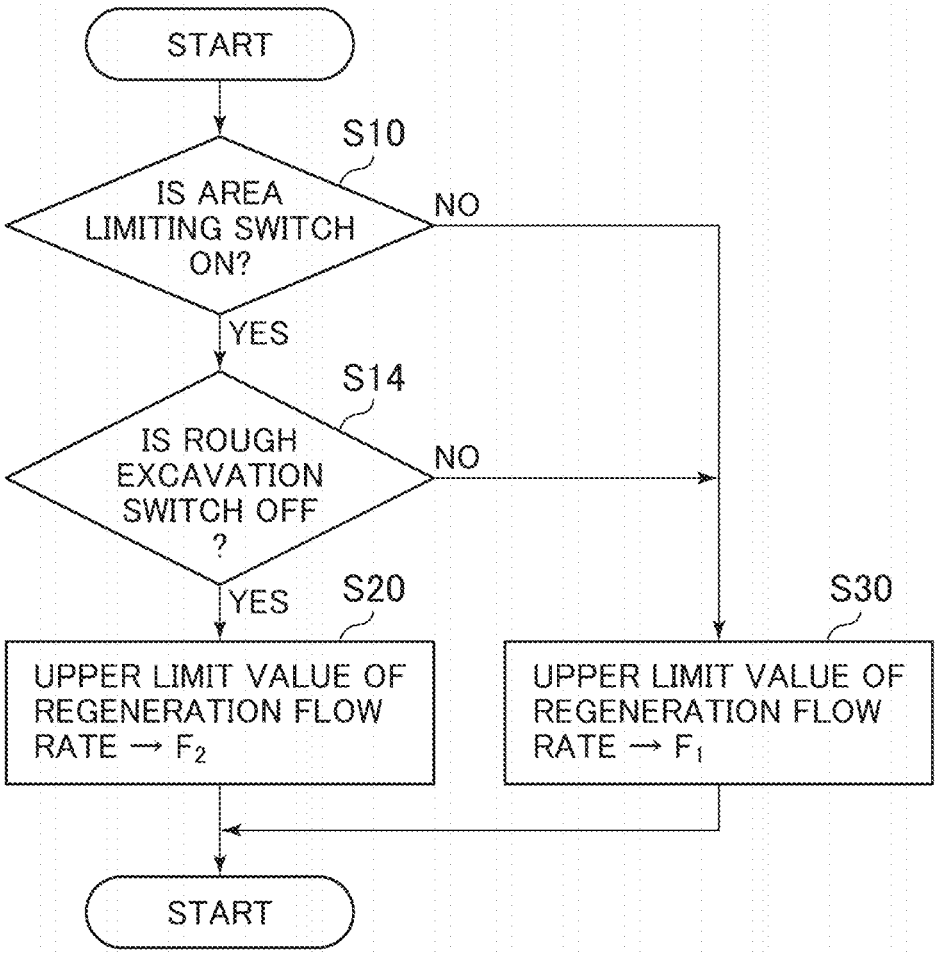
FIG. 17 is a flowchart illustrating the processing of a regeneration control switching section shown in FIG. 16.

The hydraulic excavator 1 according to the fifth embodiment of the present invention will be described with reference to FIGS. 16 and 17. FIG. 16 is a functional block diagram illustrating the controller 100 with which the hydraulic excavator according to the present embodiment is equipped, and FIG. 17 is a flowchart illustrating the processing of a regeneration control switching section 130D shown in FIG. 16.

The area limiting control section 110 according to the present embodiment is capable of being switched between a normal control mode in which priority is given to the control accuracy of the front work device 1A (hereinafter referred to as "the accuracy priority mode") and a control mode in which priority is given to the operational speed of the front work device 1A (hereinafter referred to as "the speed priority mode"). Further, as mode switching means issuing an order to the area limiting control section 110 to switch from the accuracy priority mode to the speed priority mode, the hydraulic excavator 1 according to the present embodiment is equipped with a rough excavation switch 36 (shown in FIG. 16) installed at a position where it does not interfere with the field of vision of the operator such as above the operation panel in the cab.

When, during the execution of the area limiting control, it is determined that the excavation surface 201 (shown in FIG. 4) is greatly spaced away from the target excavation surface 200, the operator operates the rough excavation switch to the ON position to effect switching from the accuracy priority mode to the speed priority mode. As a result, it is possible to increase the operational speed of the front work device 1A, making it possible to improve work efficiency at the time of rough excavation. The mode switching means is not restricted to the rough excavation switch 36. For example, the switching may be effected in accordance with the distance to the target excavation surface and the cylinder load pressure.

In the hydraulic excavator 1 according to the present embodiment, when it is determined that the distance from the excavation surface 201 to the target excavation surface 200 is small, the operator operates the rough excavation switch 36 to the OFF position to effect switching from the speed priority mode to the accuracy priority mode. That is, the rough excavation switch 36 is at the ON position only in the case where the excavation surface 201 is greatly spaced away from the target excavation surface 200. Thus, in the case where the area limiting control is being executed and where the rough excavation switch 36 is at the ON position, even if the operational speed of the arm 3 fluctuates with the hydraulic fluid regeneration in the arm cylinder 12, there is no fear of the claw tip of the bucket 4 being engaged in the ground deeper than the target excavation surface 200.

In the hydraulic excavator 1 according to the present embodiment, in the case where the area limiting control is being executed and where the rough excavation switch 36 is at the ON position, the expansion/contraction speed of the arm cylinder 12 is increased without limiting the regeneration flow rate, whereby improving work efficiency involving the area limiting control while securing the control accuracy of the area limiting control.

In FIG. 16, the difference of the present embodiment from the first embodiment (shown in FIG. 3) is that the regeneration control switching section 130D issues an order to the regeneration control section 120 to change the upper limit value of the regeneration flow rate based on the switching signal from the area limiting switch 34 and the switching signal from the rough excavation switch 36.

In FIG. 17, the difference of the present embodiment from the first embodiment (shown in FIG. 9) is that in the case where it is determined in step S10 that the area limiting switch 34 is at the ON position (YES), it is determined whether or not the rough excavation switch 36 is at the OFF position (step S14). In the case where it is determined that it is at the OFF position (YES), an order is issued to the regeneration control section 120 to set the upper limit value of the regeneration flow rate to the second set value F2 (step S20). In the case where it is determined that it is not at the OFF position (NO), an order is issued to the regeneration control section 120 to set the upper limit value of the regeneration flow rate to the first set value F1 (step S30).

In the present embodiment, the case where the area limiting switch 34 is at the OFF position or the case where the area limiting switch 34 is at the ON position and where the rough excavation switch 36 is at the ON position (that is, the case where the effect of the area limiting control is not conspicuous) is defined as "the case where the function of the area limiting control section 110 is invalid," and the case where the area limiting switch 34 is at the ON position and where the rough excavation switch 36 is at the OFF position (that is, the case where the effect of the area limiting control is conspicuous) is defined as "the case where the function of the area limiting control section 110 is effective."

Also in the hydraulic excavator 1 according to the present embodiment, it is possible to achieve the same effect as that of the first embodiment.

Further, in the hydraulic excavator 1 according to the present embodiment, in the case where the function of the area limiting control section 110 is effective (that is, in the case where the area limiting control is being executed and where the rough excavation switch 36 is at the ON position (in the case where the excavation surface 201 is to be regarded as greatly spaced away from the target excavation surface 200)), the expansion speed of the arm cylinder 12 is increased without the regeneration flow rate being limited.

As a result, it is possible to improve efficiency in a work involving the area limiting control while securing the control accuracy of the area limiting control.

The present invention, embodiments of which have been described in detail above, is not restricted to the above embodiments but includes various modifications. For example, the above embodiments have been described in detail in order to facilitate the understanding of the present invention, and are not always restricted to constructions equipped with all the components mentioned above. Further, to the construction of a certain embodiment, a part of the construction of another embodiment may be added, or a part of the construction of a certain embodiment may be deleted or replaced by a part of another embodiment.

DESCRIPTION OF REFERENCE CHARACTERS

1: Hydraulic excavator (work machine)
1A: Front work device
1B: Machine body
2: Boom
3: Arm
4: Bucket
5: Lower track structure
6: Upper swing structure
7*a*: Left traveling hydraulic motor
7*b*: Right traveling hydraulic motor
8: Swing hydraulic motor
11: Boom cylinder
12: Arm cylinder
12*a*: Bottom side chamber
12*b*: Rod side chamber
13: Bucket cylinder
14: Bucket link
21: Hydraulic pump
22: Control valve unit
23*a*: Left operation lever
23*b*: Right operation lever
23*c*: Left traveling lever
23*d*: Right traveling lever
24: Pilot pump
25: Relief valve
26: Shuttle valve
27: Tank
28*a*: Tank side line
28*b*: Pump side line
29: Check valve
31*a*: Operation device (boom)
31*b*: Operation device (arm)
32*a*: Operation device (bucket)
32*b*: Operation device (swinging)
33*a*: Operation device (left traveling)
33*b*: Operation device (right traveling)
34: Area limiting switch
35: Target excavation surface setting device
36: Rough excavation switch
41*a*, 41*b*, 42*a*, 42*b*, 43*a*, 43*b*, 44*a*, 44*b*, 45*a*, 45*b*, 46*a*, 46*b*: Pilot line
51 through 56: Flow control valve
51*a*, 51*b*, 52*a*, 52*b*, 53*a*, 53*b*, 54*a*, 54*b*, 55*a*, 55*b*, 56*a*, 56*b*: Pilot section
52L: Left side switching position
52N: Neutral position
52R: Right side switching position
60: Work implement posture sensor
61: Boom angle sensor
62: Arm angle sensor
63: Bucket angle sensor
64: Machine body inclination angle sensor
70: Operator operation sensor
71*a*, 71*b*, 72*a*, 72*b*, 73*a*, 73*b*: Pressure sensor
81*a*, 81*b*, 82*a*, 82*b*, 83*a*, 83*b*: Solenoid proportional valve
90: Regeneration circuit
91: Variable throttle
91*a*: Communication position
91*b*: Throttle position
92: Communication line
93: Check valve
94: Pressure sensor
95: Solenoid proportional valve
100: Controller
110: Area limiting control section
111: Work implement posture computing section
112: Target excavation surface computing section
113: Target operation computing section
114: Solenoid proportional valve control section
120: Regeneration control section
121: Storage section
121*a*: Relational function
122: Drive current computing section
123: Solenoid proportional valve control section
130, 130A, 130B, 130C, 130D: Regeneration control switching section
200: Target excavation surface
201: Excavation surface.

The invention claimed is:

1. A work machine comprising:

a machine body;

a front work device provided on the machine body;

a plurality of hydraulic actuators driving the front work device;

a hydraulic pump supplying a hydraulic fluid to the plurality of actuators;

a plurality of flow control valves controlling a hydraulic fluid flow supplied from the hydraulic pump to the plurality of hydraulic actuators;

a plurality of operation devices designating operation of the plurality of hydraulic actuators;

a plurality of pilot lines connecting the plurality of operation devices and pilot sections of the plurality of flow control valves;

a solenoid proportional valve provided in at least one predetermined pilot line of the plurality of pilot lines; and a controller controlling the solenoid proportional valve to correct pilot pressure of the predetermined pilot line, thereby controlling driving of the front work device, the work machine further comprising:

a regeneration circuit causing the hydraulic fluid in a tank side line of a predetermined hydraulic actuator of the plurality of hydraulic actuators to flow into a pump side line thereof, wherein the controller includes:

an area limiting control section controlling the solenoid proportional valve such that the front work implement does not intrude under a target excavation surface;

a regeneration control section adjusting flow rate of the hydraulic fluid caused to flow into the pump side line via the regeneration circuit, between zero and a predetermined upper limit value; and a regeneration control switching section that issues an order to the regeneration control section to set the predetermined upper limit value to a first set value when function of the area limiting control section is invalid, and that issues an order to the regeneration control section to set the predetermined upper limit value to a second set value that is smaller than the first set value when the function of area limiting control section is effective.

2. The work machine according to claim 1, further comprising an area limiting switch for causing the area limiting control section to function, wherein:

the regeneration control switching section issues an order to the regeneration control section to set the predetermined upper limit value to the first set value in a case where the area limiting switch is at an OFF position; and issues an order to the regeneration control section to set the predetermined upper limit value to the second set value in a case where the area limiting switch is at an ON position.

3. The work machine according to claim 1, further comprising an area limiting switch for causing the area limiting control section to function, wherein:

the regeneration control switching section issues an order to the regeneration control section to set the predetermined upper limit value to the first set value in a case where the area limiting switch is at an OFF position;

issues an order to the regeneration control section to set the predetermined upper limit value to the second set value in a case where the area limiting switch is at an ON position and where distance from a predetermined position of the front work device to a target excavation surface is smaller than a predetermined distance; and issues an order to the regeneration control section to set the predetermined upper limit value to the first set value in a case where the area limiting switch is at the ON position and where distance from the predetermined position of the front work device to the target excavation surface is not smaller than the predetermined distance.

4. The work machine according to claim 1, further comprising an area limiting switch for causing the area limiting control section to function, wherein:

the front work device has an arm;

the solenoid proportional valve is provided in a pilot line of an arm cylinder driving the arm; and the regeneration control switching section issues an order to the regeneration control section to set the upper limit value to the first set value in a case where the area limiting switch is at an OFF position, issues an order to the regeneration control section to set the predetermined upper limit value to the second set value in a case where the area limiting switch is at an ON position and where an arm pilot pressure after correction by the area limiting control section is lower than a predetermined pilot pressure, and issues an order to the regeneration control section to set the predetermined upper limit value to the first set value in a case where the area limiting switch is at the ON position and where the arm pilot pressure after the correction by the area limiting control section is not lower than the predetermined pilot pressure.

5. The work machine according to claim 1, further comprising an area limiting switch for causing the area limiting control section to function, wherein:

the front work device has a boom;

the solenoid proportional valve is provided in a pilot line of a boom cylinder driving the boom; and the regeneration control switching section issues an order to the regeneration control section to set the upper limit value to the first set value in a case where the area limiting switch is at an OFF position, issues an order to the regeneration control section to set the predetermined upper limit value to the second set value in a case where the area limiting switch is at an ON position and where a boom pilot pressure after correction by the area limiting control section is lower than a predetermined pilot pressure, and issues an order to the regeneration control section to set the predetermined upper limit value to the first set value in a case where the area limiting switch is at the ON position and where the boom pilot pressure after the correction by the area limiting control section is not lower than the predetermined pilot pressure.

6. The work machine according to claim 1, further comprising an area limiting switch for causing the area limiting control section to function, wherein:

the area limiting control section is capable of being switched between an accuracy priority mode and a speed priority mode;

there is further provided mode switching means issuing an order to the area limiting control section to switch from the accuracy priority mode to the speed priority mode; and the regeneration control switching section issues an order to the regeneration control section to set the upper limit value to the first set value in a case where the area limiting switch is at an OFF position, issues an order to the regeneration control section to set the predetermined upper limit value to the second set value in a case where the area limiting switch is at an ON position and where switching to the accuracy priority mode is ordered via the mode switching means, and issues an order to the regeneration control section to set the predetermined upper limit value to the first set value in a case where the area limiting switch is at the ON position and where switching to the speed priority mode is ordered via the mode switching means.

* * * * *